United States Patent [19]

Akachi

[11] Patent Number: 4,921,041

[45] Date of Patent: May 1, 1990

[54] STRUCTURE OF A HEAT PIPE

[75] Inventor: Hisateru Akachi, Kanagawa, Japan

[73] Assignee: Actronics Kabushiki Kaisha, Kanagawa, Japan; a part interest

[21] Appl. No.: 207,318

[22] Filed: Jun. 15, 1988

[30] Foreign Application Priority Data

Jun. 23, 1987 [JP] Japan ..... 62-155747

[51] Int. Cl.[5] ..... F28D 15/02

[52] U.S. Cl. ..... 165/104.29; 165/104.14; 165/104.22; 165/47; 165/104.26; 165/45

[58] Field of Search ..... 165/104.29, 104.22, 165/104.24, 104.26

[56] References Cited

U.S. PATENT DOCUMENTS

| | | | |
|---|---|---|---|
| 2,518,621 | 8/1950 | Hull et al. | 165/104.24 |
| 3,929,305 | 12/1975 | Sabol | 165/104.22 |
| 4,120,172 | 10/1976 | Pierce | 165/104.31 |

FOREIGN PATENT DOCUMENTS

| | | |
|---|---|---|
| 38099 | 8/1983 | Japan . |
| 178291 | 9/1985 | Japan . |
| 661885 | 11/1951 | United Kingdom . |
| 981083 | 1/1965 | United Kingdom . |
| 1266185 | 3/1972 | United Kingdom . |
| 1558551 | 1/1980 | United Kingdom . |
| 2103782 | 2/1983 | United Kingdom . |
| 2156505 | 10/1985 | United Kingdom . |
| 03680 | 10/1982 | World Int. Prop. O. . |

*Primary Examiner*—Albert W. Davis, Jr.
*Attorney, Agent, or Firm*—Bachman & LaPointe

[57] ABSTRACT

A structure of a loop-type heat pipe is disclosed in which a heat carrying fluid, preferably a bi-phase non-condensative fluid, circulates in a loop form in itself under its own vapor pressure at a high speed within an elongate pipe so as to repeat vaporization and condensation, thus carrying out a heat transfer. A structure of the loop-type heat pipe includes the elongate pipe, both ends thereof being air-tightly interconnected to form a loop-type container, the heat carrying fluid, at least one heat receiving portion and at least one heat radiating portion, both being placed at given portions of a elongate pipe, and at least one check valve for limiting a stream direction of the heat carrying fluid. A check valve(s) propels and amplifies forces generated by the heat carrying fluid and its vapor to move toward the stream direction limited by the check valve(s) so that the heat carrying fluid circulates in the stream direction through the closed-loop passage defined by the elongate pipe at the high speed, repeating vaporization at the heat receiving and radiating portions.

44 Claims, 11 Drawing Sheets

STRUCTURE OF A HEAT PIPE

BACKGROUND OF THE INVENTION (1) Field of the Invention

The present invention relates generally to a novel structure of a heat pipe which is applicable to many fields to which conventional heat pipes cannot be applied.

(2) Background of the Art

In the structure of a previously proposed cylinder type heat pipe, a working liquid is sealed within a cylindrical container and is heated and gasified at a heat receiving portion (vaporization portion) to form a vapor stream. Then, the vapor stream is raised toward a heat radiating portion (condensation portion) at a high speed.

At this time, the vapor stream is cooled and liquefied to form a working liquid stream. The working liquid, in turn; circulates toward the heat receiving portion by means of a capillary action of a wick in the container.

In this way, due to a latent heat caused by the vaporization and condensation of the working liquid during such a circulation cycle in a liquid phase and gas phase as described above a heat transfer of the cylinder-type heat pipe is carried out.

In the above-described type of the heat pipe, the working liquid and its vapor flowing in mutually opposite directions are in direct contact with each other.

On the other hand, a Japanese Patent Application First (Non-examined) Publication Sho 60-178921 published on Sept. 12, 1985 exemplifies a structure of a loop-type heat pipe. Almost all parts of a close-looped flow passage of the working liquid in the container are filled with a wick. When the heat receiving portion receives heat, the vapor generated in the wick having an end in the heat receiving portion is sprayed out toward a non-wick portion which has less fluid resistance to form the vapor stream. Then, the vapor stream is moved to the heat radiating portion and liquefied therein. The liquefied stream is then absorbed in the wick by means of the capillary action of the wick. Thus, the liquefied working liquid is recirculated to the heat receiving portion.

The loop-type heat pipe carries out the heat transfer due to the latent heat caused by a change in the phases (liquid phase and gas phase) of the filled working liquid in the circulation cycle described above in the same way as the cylinder-type heat pipe.

The above-described previously proposed structures of both cylinder-type and loop-type heat pipes have, however, the following disadvantages.

(a) Less amount of heat transport due to the presence of low limit of heat transfer.

Mutual interference between the vapor stream and liquid stream occurs due to opposite flow directions of the vapor and working liquid streams in the case of the cylinder-type heat pipe.

When a temperature difference between the heat receiving portion and heat radiating portion is increased, speeds of the vapor stream and working liquid stream are increased respectively. At this time, the working liquid evaporates from an intermediate portion of a wick surface. The working liquid is then blown up and scattered around from the wick surface toward the heat radiating portion. The scattered vapor stream disturbs the recirculated working liquid. Thus the amount of the recirculated working liquid toward the heat receiving portion is reduced. Finally, the working liquid is dried out.

In the case of a wickless-type heat pipe, the above-described phenomenon occurs at an earlier stage and more violently than the wick-type heat pipe. Therefore, the previously proposed cylinder-type heat pipe has a disadvantage of reaching a limit of heat transfer operation by relatively small amounts of heat transportation. As the length of the heat pipe is long or inner diameter of the heat pipe is small, the above-described phenomenon occurs at the earlier stage.

To avoid the above-described phenomenon, a heat insulating portion of the container can be constructed in a double pipe structure. However, the above-described double pipe structure becomes complex and very expensive.

(b) Inevitable presence of a wick limit.

In the case of the wick-type heat pipe, a thermal resistance value is low as a heat input is low and the pipe exhibits a good performance characteristic. However, if the heat input becomes large, boiling and vaporization of the working liquid are generated inside the wick. Therefore, since the recirculated working liquid cannot flow into the heat receiving portion of the wick and consequently becomes dried out. This is called a wick limit. Such a phenomenon is easy to occur as capillaries of the wick become thinner and thickness of the wick becomes thicker.

(c) The occurrence of abnormalities due to a water hammer action.

If a quantity of working liquid is increased in the case of the wickless-type heat pipe, a maximum heat transfer rate can become larger by a multiple number as compared with the wick-type heat pipe. However, if an abrupt heat input or large heat input is applied, the working liquid boils violently. Consequently, the working liquid still in the liquid phase is blown up toward the heat radiating portion and violently collides with the end surface of the heat pipe.

In this case, the heat transportation of the wick-type heat pipe becomes intermittent. In addition, an abnormal sound and an abnormal vibration are generated. In the case of the violent collision, the heat pipe container is often damaged. Such a phenomenon as described above is generated if the quantity of working liquid is too much.

(d) Presence of limits in the length and diameter of the heat pipe.

As an inner diameter of the heat pipe becomes smaller due to mutual actions of a liquid resistance and wick limit in the heat insulating portion, a limit length of the heat pipe becomes shorter. The limit length of the heat pipe having the inner diameter of 20 mm is about 10 meters and that of the heat pipe having the inner diameter of 2 mm is about 400 mm.

(e) Limited mounting orientations of the whole heat pipe during its application.

When the above-described heat pipe is used under a top heat situation, i.e., in a state where a water level of the heat receiving portion is higher than that of the heat radiating portion, even the wick-type heat pipe has a remarkably reduced heat transportation capability.

If the water level difference exceeds about 500 mm, the heat pipe becomes dried out and cannot be used any more. The thermal resistance value becomes doubled even in the horizontal posture. If the heat input becomes increased, the dry out of the working liquid easily occurs. Hence, the heat pipe is commonly used in a bottom heat state (i.e., the water level of the heat receiving portion is lower than that of the heat radiating portion) with a tilting angle of 15 to 20 degrees with respect to the horizontal direction. The wickless-type heat pipe cannot be used in the horizontal direction.

It is noted that the wickless-type heat pipe cannot function any more when the mounting orientation thereof is under the top heat situation.

(f) Difficulty in mountings on heated and cooled objects.

No flexibility is present in the above-described containers and it is almost impossible to use a product of the heat pipe without the product being bent. Hence, it is difficult or impossible to mount on the heated object and on the cooled object. If the container is formed in a corrugated-pipe configuration to provide the flexibility for the heat pipe, the heat pipe does not only become expensive but also fluidity of the working liquid becomes reduced. Consequently, the performance of the heat pipe becomes worsened.

(g) Difficulty arises in the sealing operation of the working liquid in the container.

In a case where a non-condensative gas in the container is generated or mixed, the non-condensative gas during the operation of the heat pipe stays within the heat radiating portion and the performance of the heat pipe can, thus, remarkably be reduced. To prevent such a reduced performance, a finest attention needs to be paid to maintain a high vacuum state of the heat pipe during the sealing-in operation of the working liquid.

(h) No occurrence of mutual interference in the working liquid stream in the case of the loop-type heat pipe disclosed in the above-identified Japanese Patent Application Publication.

Hence, item (a) of the above-described problems can be solved.

On the other hand, since the working liquid vaporizes within the wick, no such sudden boiling as in the case of the wickless-type pipe occurs.

Therefore, item (c) of the above-described problems can be solved.

In addition, the recirculation of working liquid toward the heat receiving portion is carried out only by means of the capillary action of the elongate wick. The long distance of the elongate wick causes the action of weight to be almost offset by means of a viscous resistance force within the filled wick. Hence, the performance difference of the loop-type heat pipe between its horizontal posture and vertical-bottom posture (the heat receiving portion is vertically placed below the heat radiating portion) described in item (e) of the above-described problems can be improved.

However, it is impossible for the loop-type heat pipe disclosed in the above-identified Japanese Patent Application to solve the problems other than items (a), (d) and (e). The loop-type heat pipe, in turn, further worsens the problems.

That is to say, at the liquid recirculation side of the heat insulating portion, the fluid resistance caused by the wick violently increases and item (b) of the problems becomes further worsened. In addition, it is extremely difficult to form the elongate wick in such a small-diameter heat pipe. Furthermore, since the loop-type heat pipe in which the vaporization of the working liquid is carried out within the wick, the problem of item (c) becomes worser and the dry out easily occurs. The problem that the heat pipe cannot almost be used under the top heat situation at the level difference exceeding 500 mm described in item (e) cannot be solved any more.

Item (f) cannot be solved. Since the disclosed loop-type heat pipe may more or less improve the item (g), there is a possibility of staying the non-condensative gas within the wick. In this case, the capillary action will be reduced and the performance of the heat pipe is thereby deteriorated.

As a new problem added to the disclosed loop-type heat pipe, the flow speed of the recirculated working liquid is determined only by means of the transport capability by means of the capillary action of the wick. Therefore, the heat transfer capability in terms of a diameter ratio of the heat pipe may not be improved more remarkably than the cylindrical heat pipe structure.

Japanese Patent Application First (Non-examined) Publications sho 62-252892 published on Nov. 4, 1987 and sho 63-49699 published on Mar. 2, 1988 exemplify the previously proposed structures of the loop-type heat pipes. Although the basic concepts of the loop-type heat pipes may be similar to that in the present invention, the present invention remarkably improves the structure of the loop-type heat pipe.

SUMMARY OF THE INVENTION

It is, therefore, an object of the present invention to provide a novel, relatively simple structure of a loop-type heat pipe which has solved all of the problems (a) to (h) described in the Background of the art which can be applied to many fields requiring such heat pipes.

The above-described object can be achieved by providing a structure of a loop-type heat pipe, comprising: (a) an elongate pipe having both ends thereof air-tightly connected to each other to form a loop-type container., (b) at least one heat receiving portion located on a first part of the elongate pipe for receiving an amount of heat thereat., (c) at least one heat radiating portion located on a second part of the elongate pipe for radiating the amount of heat thereat, (d) a heat carrying fluid filled within the elongate pipe by an amount sufficient to flow through a closed-loop flow passage defined by the elongate pipe; (e) first means for limiting a stream direction of the heat carrying fluid to a predetermined direction in the flow passage, the first means propelling and amplifying forces generated by the heat carrying fluid and its vapor to move toward the stream direction together with the heat receiving portion so that the heat carrying fluid circulates in the predetermined direction through the flow passage.

DETAILED DESCRIPTION OF THE PREFERRED EMBODIMENTS

Reference will hereinafter be made to the drawings in order to facilitate understanding of the present invention.

Figure 1:
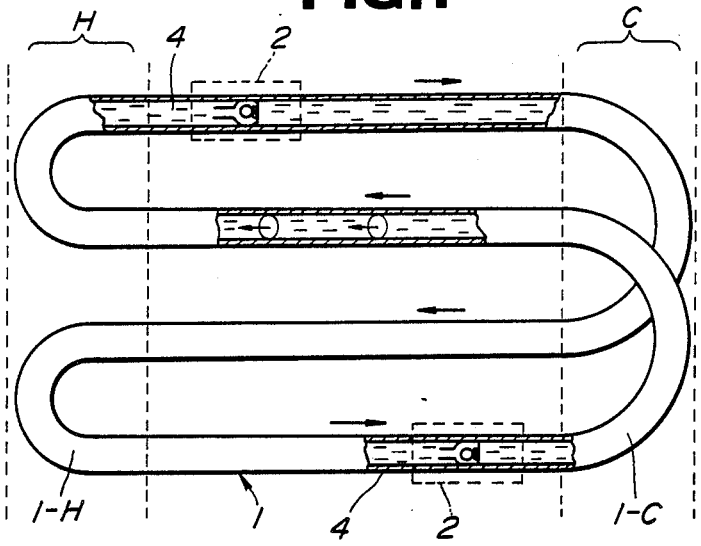
FIG. 1 is a diagrammatic partially cross sectional view of a structure of a loop-type heat pipe in a first preferred embodiment according to the present invention.

FIG. 1 diagrammatically shows a structure of the loop-type heat pipe in a first preferred embodiment according to the present invention.

In FIG. 1, a loop-type container generally denoted by 1 is formed with both terminals of a metallic pipe having a small outer diameter interconnected. The loop-type container 1 includes a heat receiving portion 1-H and a heat radiating portion 1-C, both portions being disposed via a heat insulating portion 4. These heat receiving, heat insulating, and heat radiating portions are alternately arranged to form an endless loop. It is noted that the heat receiving portion 1-H is disposed in heating means H and heat radiating portion 1-C is disposed in cooling means C. Two check valves generally denoted by 2 are installed in parts of the heat insulating portion 4 of the loop-type container 1 so as to separate the loop-type container into two.

Next, a basic theory of operation of the loop-type heat pipe in the first preferred embodiment will be described below with reference to FIGS. 1 to 4.

A basic concept of the present invention is that in the loop-type heat pipe, a working liquid in the container circulates under its vapor pressure at a high speed and repeats vaporization and condensation during the circulation cycles so that a heat transport is carried out.

The loop-type heat pipe includes the loop-type container 1 made of the metallic pipe whose both terminals are air-tightly interconnected and in which the working liquid can be circulated. The metallic tube has an outer diameter sufficient to be easily bent and has an inner diameter such that during the circulation the working liquid can stream, remaining filled in the pipe cross section due to a contributive force of a surface tension of the working liquid. The metallic pipe may be constituted by a single pipe structure or alternatively by a plurality of juxtaposed pipes or by a branched pipes in a midway thereof. The loop defined by the container may have an arbitrary bent shape provided that the flow passage of the working liquid takes the form of the endless circulation flow passage.

The loop-type container 1 is provided with the heat receiving portion and heat radiating portion, between both of which the heat insulating portion is provided. Preferably, the heat receiving and radiating portions are alternately arranged. The heat insulating portion means a heat transportation distance.

Furthermore, one or a plurality of pressure sensitive small-sized check valves, i.e., stream direction limiting means, are disposed in the circulation passage of the working liquid, mutual distances between the check valves being not markedly unbalanced. It is noted that as the number of check valves increases, the circulation of the working liquid becomes strong and fast.

In FIG. 1, the heat receiving portion 1-H generates the vapor pressure due to the vaporization of the working liquid thereat and heat radiating portion 1-C generates a negative vapor pressure (attracting force) due to the condensation of vapor. The vapor pressure and attracting force generate a strong propelling action and an action of amplifying the strong propelling force together with the check valve(s) toward a predetermined circulation direction for the working liquid and its vapor. These mutual actions cause the working liquid and its vapor to continue to circulate at the high speed in the loop-type container. The circulating working liquid is vaporized by an amount of heat supplied at the heat receiving portion to form the vapor. At this time, the amount of heat is absorbed as a latent heat in the vaporization and the vapor streams in the loop-type container. When the stream of vapor reaches the heat radiating portion, the stream of vapor is cooled and liquefied to reform the working liquid. During the liquefication, the vapor supplies the amount of heat for the heat radiating portion as the latent heat in condensation to radiate heat externally. In this way, the working liquid circulates within the loop-type container, repeating the vaporization and condensation, i.e., the heat reception and heat radiation.

Figure 2:
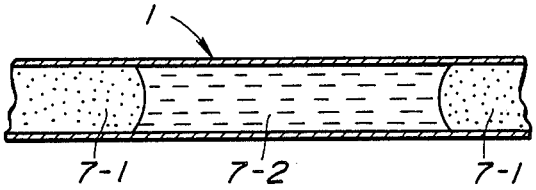
FIG. 2 is a diagrammatic cross sectional view of a part of a pipe container of the loop-type heat pipe for explaining the action of the heat pipe in the first preferred embodiment according to the present invention shown in FIG. 1.

FIG. 2 shows a behavior of the working liquid in the loop-type container 1 made of the metallic tube.

The working liquid 7-2 inside the tube 1 is filled in the tube cross section, grasped at all times by means of parts of the vapor 7-1 of the working liquid. Such a filled state is formed through mutual actions of an appropriate amount of the working liquid, an appropriate length of the inner diameter, and the surface tension of the working liquid. The filled working liquid 7-2 shown in FIG. 2 moves speedily toward a lower pressure side of the vapor pressures when a balance in pressures between the parts of the vapors 7-1 is lost. The above-described action is a basis of the circulation of the working liquid in the loop-type heat pipe.

Figure 3:
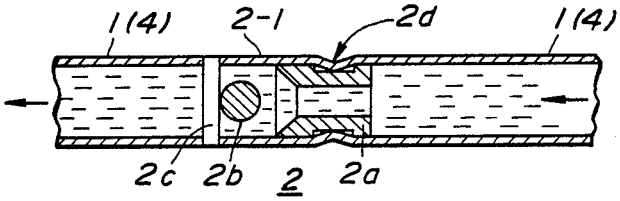
FIG. 3 is a diagrammatic cross sectional view of a small-sized check valve installed in the pipe container shown in FIG. 1 for explaining the structure of the heat pipe in a third preferred embodiment of the loop-type heat pipe according to the present invention.

FIG. 3 shows an example of the check valve 2.

The check valve 2 is constituted by a thin ring 2*a* inserted under pressure in an internal wall of the loop-type container 1 and serving as a valve seat, a valve body 2*b* having a high roundness, and a stopper 2*c*. It is noted that the valve body 2*a* is inserted and fixed through caulking of the container 1 at a portion of the container 2*d*.

Figure 4:
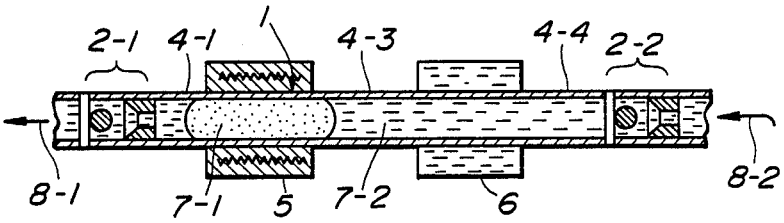
FIG. 4 is a diagrammatic cross sectional view of a part of the loop-type container for explaining the action of the loop-type heat pipe according to the present invention.

FIG. 4 schematically shows the section of the loop-type container 1 shown in FIG. 1.

It is noted that the other heat receiving and heat radiating portions 1-H, 1-C are formed at the downstream of the check valve 2-1 and the upstream of the check valve 2-2 in the container 1 although they are omitted in the drawing. Numeral 5 denotes the heating means and numeral 6 denotes the cooling means.

In the loop-type heat pipe according to the present invention, the working liquid 7-2 and its vapor 7-1 can move only in a direction denoted by 8-1, 8-2 which is limited by the check valve(s). The heat uniformity characteristic is generated through the circulation of the working liquid and its vapor. When the plurality of heat receiving portions are heated substantially at equal temperature and the temperature of the heat receiving portion 1 shown in FIG. 4 is slightly higher, the generated vapor pressure closes the check valve 2-2 and opens the other check valve 2-1 so that the vapor 7-1 is sprayed out in the downstream direction 8-1.

This causes the filled working liquid to flow into the heat receiving portion (not shown in FIG. 4) located downstream of the heat receiving portion shown in FIG. 4 at which the working liquid generates a large amount of vapors. The generated vapor pressure once closes the check valve 2-1. A temperature of the part 4-1 of the container 1 shown in FIG. 4 and the vapor 7-1 drop due to a heat dissipation and an adiabatic expansion in the vapor 7-1 at the heat insulating portion 4-1. In addition, the vapor pressure at the heat insulating portion 4-4 drops due to the shrinkage of vapor. Thus, the other check valve 2-2 is open to receive the vapor and working liquid located at the upstream of the check valve 2-2. At this time, the temperature of the container block 1 shown in FIG. 4 is again increased and the internal pressure thereat is increased. Then, the check valve 2-2 is again closed and the check valve 2-1 is again open. Thus, the vapor 7-1 and the working liquid at the heat insulating portion 4-1 are sprayed out via the check valve 2-1 toward the downstream direction of the container 1.

Although the action described above is only related to the vapor spraying action by means of the heat receiving portion, the absorbing action for absorbing the vapor and working liquid from the upstream direction caused by a negative pressure generated when the heat radiating portion receives heat and liquefies the vapor reinforces a respiratory action of the container described above in synchronization with the action at the heat receiving portion. Such a respiratory action as described above causes the working liquid and its vapor to be propelled in the direction limited by the check valves 2-1 and 2-2, the teat receiving and radiating portions repeating minute cyclic rise and drop in temperature . The experiments indicated that as the heat input was increased a change range of the temperature became smaller and the repetition period became smaller. The heat transportation capability of the heat pipe became increased as the change range of the temperature and the repetition period became smaller.

On the other hand, the two check valves 2-1, 2-2 need not be installed for the couple of the heat receiving and radiating portions. The number of the check valves may be arbitrary. That is to say, the experiment indicated that even when a single check valve was used in the container 1, the loop-type heat pipe could be operated although the performance was reduced.

Furthermore, the stream of the working liquid whose speed and flow quantity are reduced due to a pressure loss generated by means of a fluid resistance in the internal wall of the pipe container is once gasified whenever it reaches the heat receiving portion at which a saturated vapor pressure is given according to the temperature at the heat receiving portion. The saturated vapor pressure propels the working liquid located at the downstream of the heat receiving portion as a new propelling energy. The amplification of the loop-type heat pipe is generated in the way described above.

In addition, the amplification is generated in the way described below.

That is to say, the vapor stream whose speed and flow quantity are reduced due to the pressure loss generated by means of the fluid resistance in the internal wall of the container is once liquefied at the heat radiating portion at which the negative vapor pressure is generated. The generated negative vapor pressure causes the working liquid located at the upstream of the heat receiving portion to be absorbed so that the propelling force is recovered.

A magnitude of the amplified propelling force to the working liquid is determined according to the temperatures at the heat receiving and radiating portions and the temperature difference between both portions. That is to say, the propelling force is determined according to a pressure difference of the saturated vapor pressures at the temperatures of both portions. The circulation speed is also determined according to the above-described pressure difference.

In the way described above, the circulating working liquid transports a certain amount of heat from the heat receiving portion to the heat radiating portion, repeating the vaporization and condensation of the working liquid.

As shown in FIG. 1, the container takes the form of the endless loop like a numeral 8. The whole shape of the container 1, however, may be elliptic or arbitrary.

It is noted that a Japanese Patent Application First Publication (Tokkai) sho 63-49699 published on Mar. 2, 1988 exemplifies a previously proposed loop-type heat pipe. The disclosed heat pipe structure is similar to that according to the present invention but the structure and its operation theory are quite different from those of the present invention. That is to say, the disclosed heat pipe is a composite heat pipe provided with a pipe container having a capillary action and a working liquid reserving container having principally no capillary action. The position(s) at which the stream direction limiting means is disposed is limited to the inner part of the working liquid reserving container.

The disclosed heat pipe is operated upon such a theory of operation as described below.

Due to the capillary action of the pipe container, the working liquid stored in the working liquid reserving container is absorbed or soaked up and then transported by means of the capillary action. The stream direction limiting means prevents the working liquid from returning to the working liquid reserving container during the operation and limits the circulating propelling force generated due to the capillary action to a predetermined direction. Since the circulating propelling force and circulating flow quantity generated due to the capillary action are determined spontaneously depending on the inner diameter of the pipe container, the propelling force due to the vapor pressure of the working liquid and absorbing force due to the condensation of the working liquid are offset by means of the strong fluid resistance of the capillary pipe container. The circulating propelling force and flow quantity due to the capillary action are slightly increased so that the vapor pressure saturation results. Therefore, it is impossible to provide the loop-type heat pipe with the high heat transportation capability as in the present invention. Although the propelling force can be reinforced and flow quantity can be increased by the alternate cooling and heating of the plurality of working liquid reserving containers, a pattern of the stream of the working liquid is intermittent and thus it is impossible to generate such a continuous stream of the working liquid as in the heat pipe according to the present invention. The disclosed heat pipe is essential to receive an external auxiliary energy. Since the working liquid propelling force is derived by means of the capillary action, it is necessary to reduce the inner diameter of the container in order to improve the top heat characteristic and to elongate the distance between the heat receiving and heat radiating portions (the transport distance of the working liquid per heat receiving portion). However, this means the reduction of the flow quantity of the working liquid and remarkable decrease in the heat transporting capability.

(Second preferred embodiment)

The loop-type heat pipe in the second preferred embodiment has a feature that together with a predetermined quantity of the predetermined working liquid filled in the container the predetermined quantity of the predetermined non-condensative gas is also filled in the container.

The heat pipe in the second preferred embodiment according to the present invention does not generate such an operation stopped portion as in the conventional heat pipe even though the non-condensative gas is externally mixed. Therefore, the performance can be adjusted by controlling the mixed amount of non-condensative gas.

Figure 7:
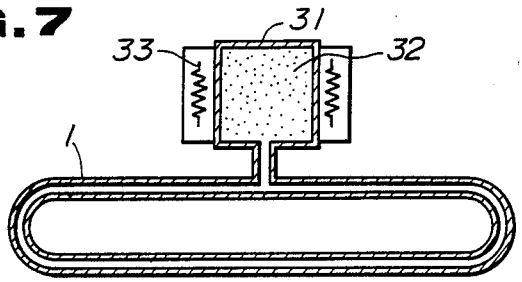
FIG. 7 is a diagrammatic partially cut out cross sectional view of a variable conductance type loop-type heat pipe in a second preferred embodiment according to the present invention.

FIG. 7 diagrammatically shows the example of application in the second preferred embodiment, i.e., variable conductance type loop heat pipe. Numeral 31 denotes a gas storage tank for the non-condensative gas. Numeral 32 denotes the non-condensative gas filled therein. Numeral 33 denotes temperature controlling means for increasing or decreasing the temperature within the tank so that the non-condensative gas is expanded or constricted and the amount of the non-condensative gas within the loop-type container is adjusted and the heating and cooling capabilities of the loop-type heat pipe can freely be changed.

(Third preferred embodiment)

In the third preferred embodiment, a higher performance can be exhibited than that of the heat pipe in which the pure water working liquid is filled in the pipe container 1 described in the first preferred embodiment and in which Freon-11 is filled in the container 1 described in the first preferred embodiment.

The loop-type heat pipe has the structure capable of withstanding an extremely high internal pressure as described before and therefore the wider extension of the selection range of the working liquid can be extended. Consequently, the high performance heat pipe can be achieved.

In the third preferred embodiment, the working liquid filled in the loop-type container 1 is a working liquid such that a total product value of the numerical values of the saturated vapor pressure indicated in a predetermined temperature range and of an inverse number of a liquid-phase dynamic viscosity coefficient at each same temperature is greater than that in the case of Freon-11 at each same temperature.

The experiment data in the first preferred embodiment confirmed that in the loop-type heat pipe according to the present invention the loop-type heat pipe in which Freon-11 was used as the working liquid indicated a better thermal resistance value than that in which the pure water was used as the working liquid in the predetermined temperature range and had at least a better or equal performance. This shows that the performance exceeds the conventional heat pipe more remarkably than was expected. It was estimated that a synergic effect that the saturated vapor pressure of Freon-11 in the region of temperature during the experiment is ten times higher than that of the pure water and that the liquid-phase dynamic viscosity coefficient is $\frac{1}{3}$ lower than that of the pure water greatly increases the circulation speed of the working liquid and the latent heat at the time of the phase change of Freon-11 is only 1/13 lower than that of the pure water. Such an effect as described above can be applied to the selection of the working liquid to provide the high performance for the loop-type heat pipe. For example, the saturated vapor pressure at 25° C. of Freon-11 indicates 2.5 $Kg/cm^2$ which is about twice 1.2 $Kg/cm^2$ in the case of Freon-11. Similarly, the dynamic viscosity coefficient at 25° C. indicated by $0.25\times10^{-6}$ $m^2/sec.$ is 1/1.2 lower than $0.29\times10^{-6}$ $m^2/sec.$ in the case of Freon-11. The total product value of these values is 2.52 times than that in the case of Freon-11.

Freon-11 and Freon-114 were filled by 60% with respect to the inner volume of the pipe container 1 used in the first preferred embodiment and the heat transport capacities measured at the temperature of the heat receiving portion of 50° C. and the temperature of the heat radiating portion of 23° C. ware 55W and 400W, respectively.

In this way, the wide selection of the working liquid can effectively be achieved. For example, if Freon-series working liquid is selected, the heat transport capacity cannot be reduced only with the replacement of a part of the container 1 with the electric insulating object so that the heat receiving portion and heat radiating portion can electrically be insulated. In addition, the operating range can be extended in the range from −50° C. to 150° C. (in the case of the pure water working liquid, 20° C. to 200° C.). Furthermore, the application of aluminum container to the loop-type container 1 becomes possible so that the flexible and light-weight characteristic is improved without reduction of the performance of the loop-type heat pipe.

(Fourth preferred embodiment)

In the fourth preferred embodiment, all or predetermined parts of the loop-type container in the loop-type heat pipe according to the present invention are completely annealed. It becomes possible to bend the loop-type container universally through predetermined bending means. Since the loop-type heat pipe according to the present invention can extremely be elongated, the high flexibility can be assured if the outer diameter is below 10 mm without modification in a suitable range of radius of curvature. However, if the container is completely annealed and softened, the radius of curvature is remarkably reduced and the mounting operation of the pipe becomes easy. It is convenient to carry it during the storage and shipment of the heat pipe products since the heat pipe can be wound on a frame or bundled. Particularly, since the pure copper container, pure aluminum pipe, or aluminum alloy pipe is most commonly used, the extremely feasible bending can be assured in cases where the heat pipe containers made of the above-described metals and having the outer diameter below 4 mm are completely annealed. It becomes possible for the completely annealed container to align with a bent elongated body, to be wound around an elongated heat generating wire strip, or sticked on a curved surface. Consequently, the heat pipe container can be cooled and heated.

(Fifth preferred embodiment)

FIG. 8(A) to 8(F) show a fifth preferred embodiment to the loop-type heat pipe according to the present invention.

The loop-type container 1 in the fifth preferred embodiment is formed with any one of various types of pipes, i.e., pipes having a circular cross section, an elliptic cross section, a square cross section, a rectangular cross section, and having a multiple number of capillarities on internal wall surfaces of the pipes having cross sections described above.

FIG. 8(A), 8(B), 8(C), and 8(D) show conditions in which respective pipe portions are grasped by means of heat generating means and/or heat radiating means in order to provide a wide heat transmission area and a favorable heat transmission efficiency.

Figures 8A, 8B, 8C:
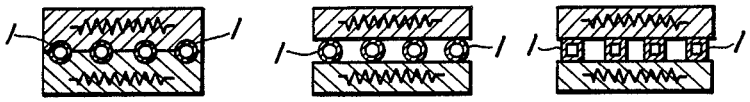
FIGS. 8 (A) to 8 (F) are cross sectional views of various types of the loop-type containers of the loop-type heat pipe structure in a fifth preferred embodiment according to the present invention.
Figures 8D, 8E, 8F:
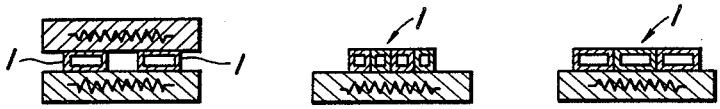

FIG. 8(E) and 8(F) show states in which the square pipes and rectangular pipes are juxtaposed, adhered to form the heat pipes in tape forms, respectively.

The elliptic pipes and flat rectangular pipes are very flexible with the elongated axles in the cross section as the neutral axle. It is convenient to mount them on the curved surface and/or to form the stream direction switching portions therein.

(Sixth preferred embodiment)

Figure 9:
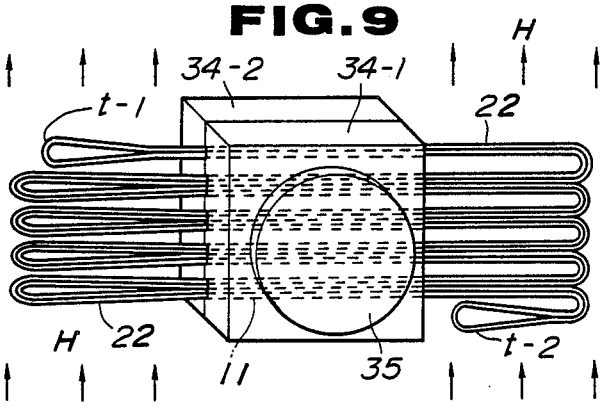
FIG. 9 is a perspective view of a flat-type thyristor cooler in which the loop-type heat pipe in a sixth preferred embodiment according to the present invention is applied.

FIG. 9 shows a sixth preferred embodiment of the loop-type heat pipe according to the present invention.

An outer periphery of the loop-type heat pipe container is coated with a thin, rigid, electrically insulating material having a good heat conductivity and a high heat resistivity according to a use temperature of the heat pipe.

In FIG. 9, a flat-type silicon controlled rectifier 35 (reverse blocked triode thyristor, or simply thyristor) is grasped and cooled by means of a pair of cooling blocks 34-1 and 34-2 made of copper under pressure. The cooling blocks 34-1 and 34-2 serve as a conductive passage of a high electric power.

In addition, the loop-type heat pipe is formed in a zig-zag fashion between the tightly attached pair of cooling blocks 34-1 and 34-2. The amount of heat generated by the thyristor 35 is absorbed via the pair of the cooling blocks 34-1, 34-2 made of copper and is radiated in arrow-marked directions together with a cooling air through the heat radiating portion 22 of the heat pipe. Numeral 11 denotes the heat receiving portion.

Since the loop-type heat pipe container in the sixth preferred embodiment coated with the electrically insulating material is effective to prevent an electrical discharge. The insulating coating may be provided on the heat receiving portion and/or heat radiating portion or the whole surface of the pipe container. Various types of enamel baked coatings may be used.

(Seventh preferred embodiment)

Figure 10:
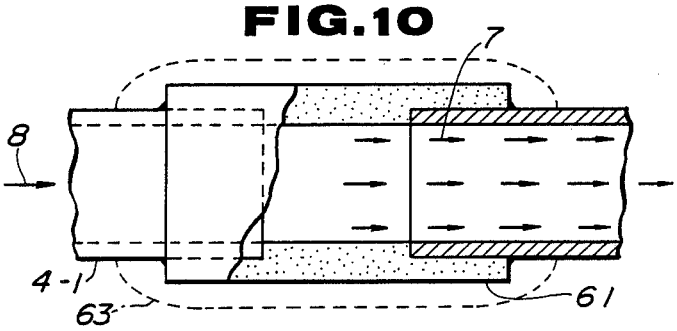
FIG. 10 is a partially cross sectional view of an electrically insulating portion of the loop-type heat pipe in a seventh preferred embodiment according to the present invention.

FIG. 10 shows a seventh preferred embodiment of the loop-type heat pipe according to the present invention.

As shown in FIG. 10, a part 4-1 of the pipe container placed between the heat receiving portion and heat radiating portion is electrically insulated in the same way as that described in the sixth preferred embodiment.

It is noted that FIG. 10 shows a predetermined part of the heat insulating portion of the loop-type container in which the metallic pipe of the heat insulating portion is cut out and separated into two pipes which are linked with a ceramic pipe 61 made of such an electrically insulating material as a ceramic.

In FIG. 10, numeral 7 denotes an electrically working liquid and numeral 8 denotes its stream. In addition, numeral 63 denotes a protective paint coating such as epoxy resin for reinforcing a nonpermeability of the insulating portion.

(Eighth preferred embodiment)

As shown in FIG. 3, in an eighth preferred embodiment, the check valve(s) as the stream direction limiting means is incorporated in the working liquid stream passage of the pipe container 1.

Each check valve 2-1 is disposed in a predetermined portion (internal wall of the container) of the working liquid stream passage in the loop-type container 1. Each check valve 2-1, 2-2 includes a thin pure copper or aluminum valve seat which is inserted in the container 1 under pressure valve seat 2*a* which is fixed in the predetermined portion through caulking, a valve body 2*b* having a ball made of corundum ($Al_2O_3$), and a valve body stopper 2*c* for holding the valve body 2*b* in a floating state at a predetermined position from the valve seat 2*a*.

A contact portion of the valve seat 2*a* with the valve body 2*b* is tapered.

A spatial interval between the ball-shaped valve body 2*b* and valve seat 2*a* is defined by means of the stopper 2*c* and is held in the floating state.

The stopper 2*c* has a simple structure in which a pure copper pin or aluminum pin is pressed in a penetrated hole of the pipe and thereafter brazed. The stopper may arbitrarily be formed.

The check valves constructed in the way described above has the following actions.

(i) high reliability due to its simple structure.

(ii) capability of maintaining an anti-corrision characteristic for a long period of time since the check valve is constituted by the pure copper and corundum ($Al_2O_3$) and high adaptability for the pure copper working liquid and Freon-series working liquid is assured.

(iii) Since the ball-shaped body of corundum ($Al_2O_3$) is extremely rich in anti-wear characteristic and the associated valve seat is made of extremely soft metal, the working life of the check valve is substantially permanent.

(iv) Since the good air-tightness characteristic is assured with time since the valve seat made of pure copper or aluminum becomes so deformed as to fit to the ball-shaped valve body.

(v) Since the corundum ($Al_2O_3$) is extremely as light as the relative weight of 0.4, the high air-tightness and separability against the valve seat and high sensitivity can easily be assembled.

(vi) Since the construction of the check valve is relatively simple and the check valve can be assembled in the heat pipe container.

Consequently, the long working life of the heat pipe and high reliability of the heat pipe can be assured.

The material constituting the valve seat of the check valve may be pure copper or alternatively aluminum if the used working liquid is Freon-series and may be pure copper if the working liquid is pure water. In addition, if the working liquid is neither the pure water nor Freon series, a metallic material having a good adaptability to the working liquid is required to be selected. The ball-shaped valve body is also required to be adaptable to the working liquid.

In a case where the pipe container 1 has the inner diameter below 1 mm and miniaturization of the check valve 2 is difficult, the diameter of the pipe container at the position at which the check valve is installed may be increased as compared with the other portions.

The corundum ($Al_2)_3$) may be ruby or sapphire.

(Ninth preferred embodiment)

FIGS. 11 (A) to 11 (D) show a ninth preferred embodiment of the loop-type heat pipe container according to the present invention.

In the ninth preferred embodiment, endless pipe portions corresponding to a liquid forward flow passage and rearward flow passage of the working liquid stream are adjoined and juxtaposed. In addition, both ends of the heat pipe container are constituted by the stream direction switching portion of the working liquid stream are formed (linkage portion) in the bent pipe having a predetermined radius of curvature.

Figure 11A:
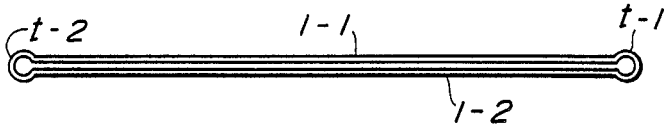
FIGS. 11(A) to 11(D) are partial cross sectional views of examples of applications of the loop-type heat pipe in a ninth preferred embodiment according to the present invention.
Figure 11B:
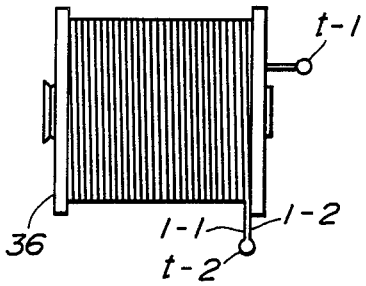
Figure 11C:
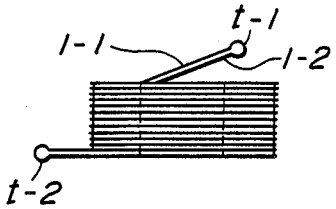
Figure 11D:
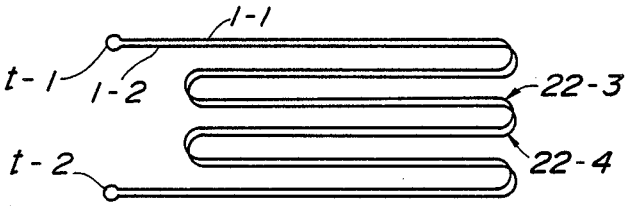

FIG. 11(A) shows a basic example of the loop-type heat pipe container.

Figure 5A:
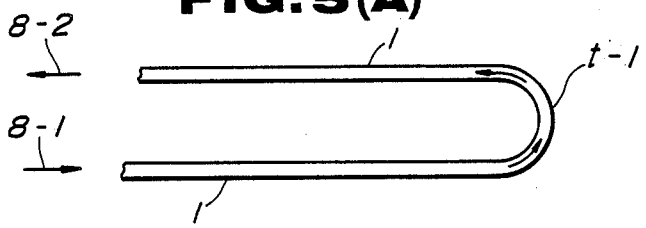
FIGS. 5 (A) to 5 (K) are diagrammatic partial elevational and cross sectional views of a stream direction switching portion of the heat pipe for explaining the structure of the loop-type heat pipe according to the present invention.
Figure 5B:
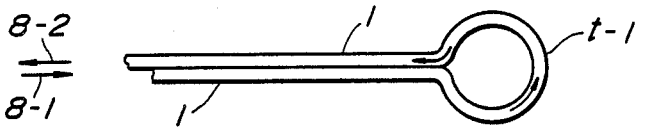
Figure 5C:
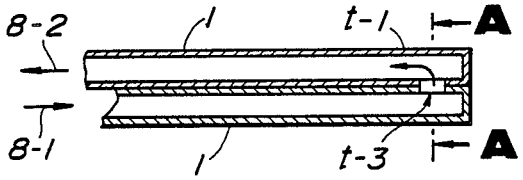
Figure 5D:
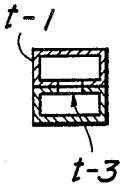
Figure 5E:
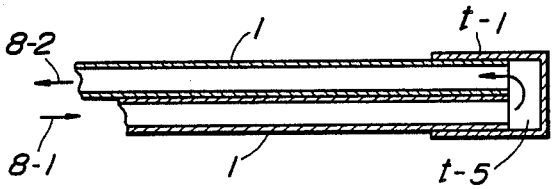

As shown in FIG. 11(A), a straight pipe portion 1-1 is provided in which the working liquid streams forward (in the rightward direction as viewed from FIG. 11(A)) and another straight pipe portion 1-2 of the container 1 is provided in which the working liquid streams rearward (in the leftward direction as viewed from FIG. 11(A)). Both straight pipe portions 1-1, 1-2 are adjoined and juxtaposed. A plurality of check valves are arranged in the pipe container (not shown). The stream direction switching portions denoted by t-1 and t-2 are constituted by the bent pipe portions. Refer to FIGS. 5(A) and 5(B) for the profile of the bent pipe portions of the heat pipe container shown in FIG. 11(A). The loop-type heat container thus constructed can become easy to handle.

FIG. 11 (B) shows another example of the application of the loop-type heat pipe in which the loop-type pipe container is wound around a winding frame 36 with the bent pipe portions t-1 and t-2 being served as both ends of the wound pipe.

FIG. 11 (C) shows still another example of the application of the loop-type heat pipe container in which the pipe container can be wound and bundled about the winding frame.

FIG. 11 (D) shows a further example of the application of the zig-zag loop-type heat container in which a linkage pipe portion for linking both ends of the pipe is not required and the zig-zag shaped heat pipe is resilient so that a package transportation can be achieved. Consequently, a transportation of large amounts of heat pipe products can be achieved.

(Tenth preferred embodiment)

Figure 12A:
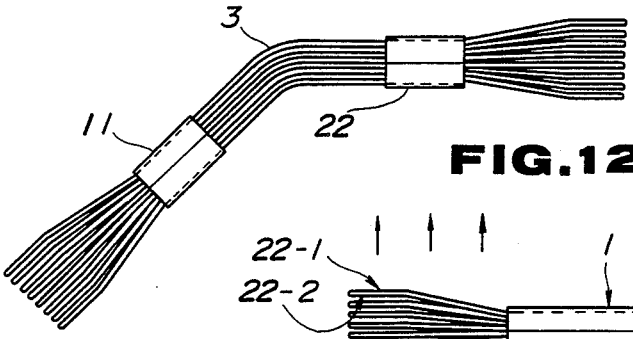
FIGS. 12 (A) and 12 (B) are partially cross sectional views of examples of the loop-type heat conductive pipe in a tenth preferred embodiment according to the present invention.
Figure 12B:
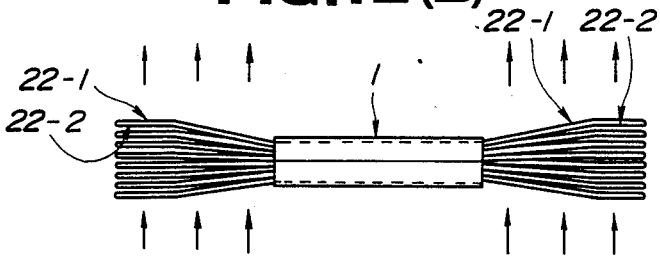

FIGS. 12(A) and 12(B) show a tenth preferred embodiment of the loop-type heat pipe according to the present invention.

The tenth preferred embodiment enables the effective utilization of latent heats of vaporization and condensation at such an expanded heat transmission area.

In FIG. 12(A), the heat receiving portion 11 and heat radiating portion 22 are installed as the predetermined portions, respectively. The heat receiving and heat radiating portions 11, 22 are formed with the metallic pipes having high heat conductivities in which a bundle of the heat pipe containers are held under pressure. In addition, the above-described heat-conductive filling materials are filled in all the clearances provided in the metallic pipes in order to improve the heat transmission efficiency.

Each metallic pipe is tightly fitted into the above-described insertion hole (not shown).

The heat receiving portion 11 and heat radiating portion 22 are formed with the corresponding metallic pipes. Both ends of the bundle of the pipe containers are the aggregate portions of the heat pipe group and have a larger outer diameter than the remaining bundled portions. The heat insulating portion 4 between the heat receiving and heat radiating portions 11 and 22 is flexible so as to be bent through a certain angle.

FIG. 12(B) shows another example of the tenth preferred embodiment in which only the heat receiving portion 11 is grasped by means of the single metallic pipe and the other parts are aggregates of the heat radiating portions 22-1, 22-2 of a forced-air convection type.

(Eleventh preferred embodiment)

Figure 13:
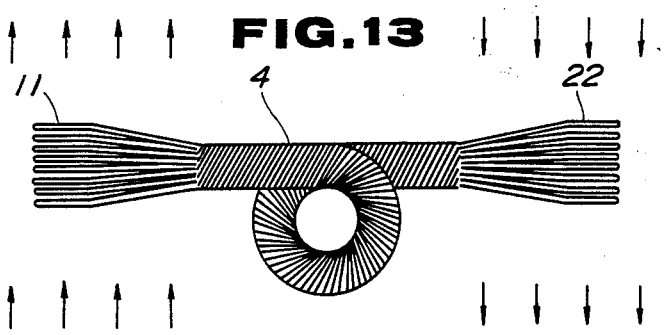
FIG. 13 is a partially cross sectional view of other examples of the loop-type heat pipe in an eleventh preferred embodiment according to the present invention.

FIG. 13 shows an eleventh preferred embodiment of the loop-type heat pipe according to the present invention.

As shown in FIG. 13, predetermined portions 4 of the plurality of elongated pipes are mutually twisted.

The plurality of the elongated pipes are twisted at the heat insulating portion 4 to reduce an occupying percentage therefor and to improve flexibility. In addition, since each elongated pipe is thermally contacted together to compensate for the temperature variation, a uniform heat distribution of the whole loop-type heat pipe container can be assured.

(Twelfth preferred embodiment)

FIGS. 14(A) to 14(E) show a twelfth preferred embodiment of the loop-type heat pipe according to the present invention.

In the twelfth preferred embodiment, the loop-type container is constituted by any one of a single elongated thin pipe, parallel elongated thin pipes, or twisted elongated thin pipes.

The container is bent at a plurality of predetermined portions in the bent pipe forms having the predetermined radius of curvatures and constituting the direction switching portions of the working liquid stream so that the zig-zag shaped loop-type container is formed.

Any one of the heat receiving portion 11, heat radiating portion 22 or both are installed for each turn of the zig-zag container. The twelfth preferred embodiment is concerned with a basic shape of the zig-zag shaped container.

In FIGS. 14(A) to 14(E), numeral 5 denotes heating means and numeral 6 denotes cooling means. Parts of the container with which the heating means 5 and cooling means 6 are contacted constitute the heat receiving portion 1 and heat radiating portion 2, respectively. In addition, symbols t-1 and t-2 denote the stream direction changing portions of the working liquid at both ends of the plurality of the pipes. For the shapes of the direction switching portions, refer to FIG. 5(A) to 5(F).

When the zig-zag loop is formed in the container, it makes easy to dispose alternately the heating means 5 and cooling means 6 and to dispose the thin heat pipe container, and to carry out the mounting operation of the heat pipe container with less effort at a fixed site. The shape of the bent pipe container is determined on the basis of the disposed conditions of the heating means (heat generating object) and cooling means (heat absorbing object).

Figure 14:
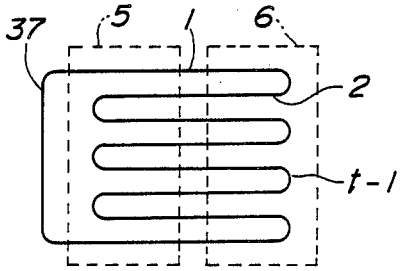
FIGS. 14 (A) to 14 (E) are diagrammatic elevational views of various types of the pipe containers in a twelfth preferred embodiment according to the present invention.
Figure 14:
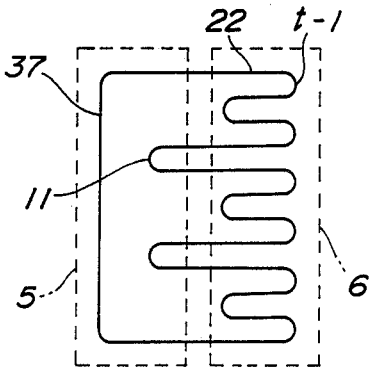
Figure 14:
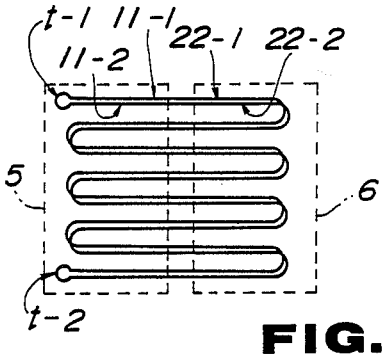
Figure 14:
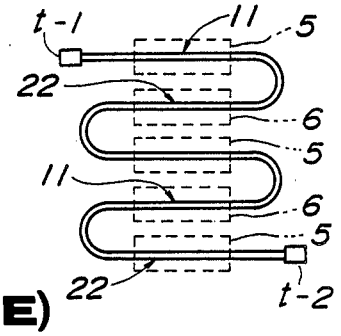
Figure 14:
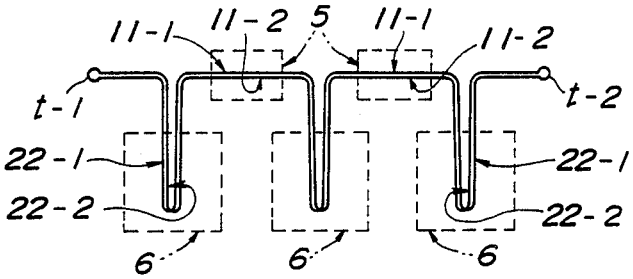

It is noted that FIGS. 14(A) and 14(B) show examples of the zig-zag type loop pipe container in which both heat receiving portion and heat radiating portion are disposed for each turn of the pipe container.

In FIG. 14(A), both heat receiving portion and heat radiating portion are usually formed for each turn of the single pipe and both ends of the pipe is linked with the linkage pipe 37.

In FIG. 14(B), the number of turns of the heat radiating portion 22 is increased if the heat transmission efficiency of the heat radiating portion 22 is relatively low as compared with the heat receiving portion 11. In addition, the linkage pipe 37 links both ends of the heat pipe.

Each example of FIGS. 14(C) to 14(E) is the zig-zag loop containers constituted by a plurality of parallel pipes and twisted pipes. Since no such a linkage pipe 37 as shown in FIGS. 14(A) and 14(B) is required, a special winding frame is used during the transportation between each production step and shipment of the heat pipe product.

The heat pipe container is formed according to the positions of the heating means 5 and cooling means 6.

As shown in FIG. 14(C), the two couples of the heat receiving portions and heat radiating portions 11-1, 11-2 and 22-1, 22-2 are disposed for each turn.

As shown in FIG. 14(D), the heat receiving portions 11-1, 11-2 of the container are disposed along the elongated heat generating portion 5 such as a power cable. Alternatively, the heat receiving portions 11-1, 11-2 are wound around the heat generating object 5 such as an electric motor, electromagnetic magnet. In these cases, the heat radiating portions 22-1, 22-2 are extended from the heat receiving portions 11-1, 11-2 and disposed along the cooling means 6. The heat radiating portions 22-1, 22-2 are formed with two pipe portions for each turn of the container.

Since the loop-type heat pipe according to the present invention can completely be operated at a maximum heat posture, the heat radiating portions 22-1, 22-2 can be located substantially below or straight below the heat receiving portions 11-1, 11-2. In FIG. 14(D), the heating means 5 and cooling means 6 are adjoined and the twisted pipe containers are formed in the zig-zag configuration.

In addition, if straight line portions are closely contacted and juxtaposed as shown in FIGS. 14(A) and 14(C), the loop-type container can be used for a surface cooling of a flat-shaped heating/cooling means such as a printed circuit board.

In the printed circuit board, in this case, super conductive elements can be mounted thereon with the pipe container mounted on the circuit switchboard.

(Thirteenth preferred embodiment)

Figure 15:
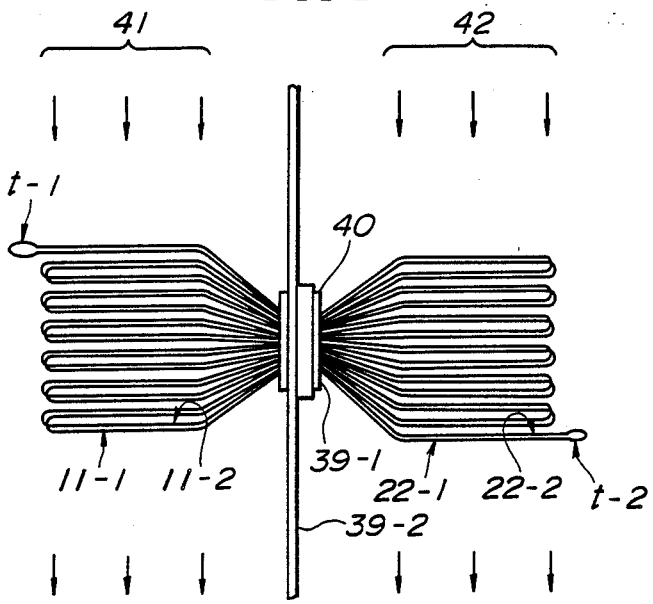
FIG. 15 is an elevational view of an example in a thirteenth preferred embodiment according to the present invention which is applicable for fire-proof, heat-resistant, and flame-proofing electric cables.

FIG. 15 shows a thirteenth preferred embodiment of the loop-type pipe according to the present invention.

In the thirteenth preferred embodiment, a predetermined portion of the loop type container is formed in the zig-zag configuration with a multiple number of turns.

A predetermined portion placed behind each turn of the container constitutes the heat insulating portion. Such a heat insulating portion group is aggregated in the bundle, is penetrated through a predetermined tube or frame, and is held under pressure. All clearance in the predetermined tube or frame are tightly filled with predetermined filling materials.

A heat exchanger can easily be constructed by inserting the tube or frame 39-1 into a mounting hole 40 of a partition wall 39-2, as shown in FIG. 15. Before the tube or frame 39-1 is mounted on the partition wall 39-2, the aggregate of the pipe containers 11-1, 11-2, or 22-1, 22-2 has a smaller diameter of the tube or frame 39-1. After the tube or frame 39-1 is inserted into the mounting hole 40, the thin pipe containers 11-1, 11-2 , 22-1, 22-2 are extended outward from the tube or frame 30 as shown in FIG. 15.

Even if no particular fin group is inserted in the tube or frame 39-1, the pipe group can radiate the amount of heat absorbed from a high temperature fluid body 41 efficiently to a low temperature fluid body 42.

(Fourteenth preferred embodiment)

Figure 16A:
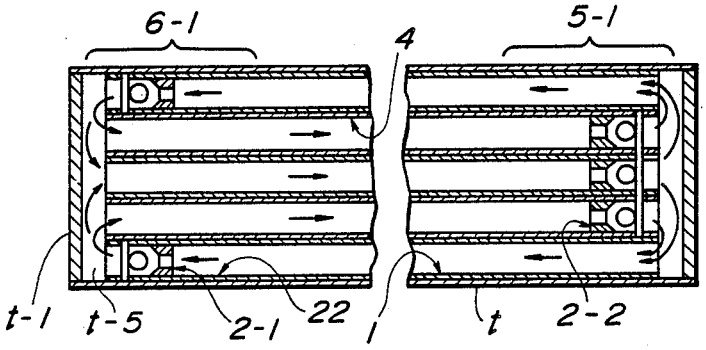
FIGS. 16 (A) and 16 (B) are diagrammatic elevational and partially cross-sectioned views of the loop-type heat pipe in a fourteenth preferred embodiment according to the present invention.
Figure 16B:
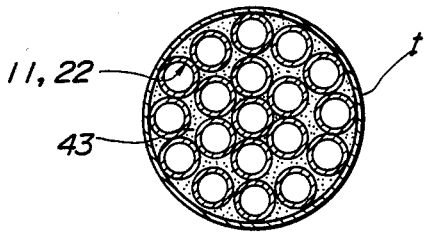

FIGS. 16(A) and 16(B) show a fourteenth preferred embodiment of the loop-type heat container according to the present invention.

In the fourteenth preferred embodiment, the loop-type container 1 (11, 22, 4) is assembled within an outer pipe container t made of a tightly sealed metallic tube having a high heat conductivity. A multiple number of aggregates of the thin pipe containers corresponding to the passages of the working liquid stream are tightly fitted into the outer pipe container t. It is noted that a cavity chamber corresponding to the stream direction switching portion is left between one of both end surfaces of the aggregates of the pipe containers and inner wall of both end surfaces of the outer pipe container t.

Preferably, all clearances between each inner wall of the outer tube container and pipe aggregates and between mutual pipes are air-tighted. Furthermore, each of predetermined pipes is provided with the check valve. The direction of the working liquid stream limited by means of the check valve is the forward direction of the working liquid in the plurality of predetermined pipes of the aggregate of the pipes. A plurality of the remaining pipes has a rearward direction. As a whole, the working liquid streams are designed to form the loops. The aggregates of thin pipe containers are then inserted in the outer pipe container t as shown in FIG. 16(B). Particularly, the heating portion 5-1 and the cooling portion 6-1 are provided in the outer pipe container t.

On the other hand, the corresponding thin pipe containers are provided with the heat radiating portion 22 and heat insulating portion 4. The cavity chamber t-5 between the inner wall of the outer pipe container t and one end surface of the thin pipe container group serves as the header of the working liquid.

Figure 5F:
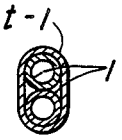
Figure 5G:
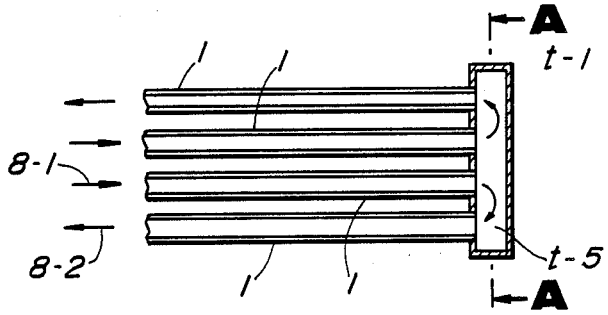
Figure 5H:
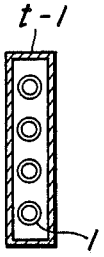

In the fourteenth preferred embodiment, the stream direction switching portions t-1 of the working liquid shown in FIG. 5(F) are provided at both ends of the aggregate of the thin pipe containers. Hence, the vacant chambers t-5 provided in both ends of the outer pipe container t shown in FIG. 15 serve to change the direction of the working liquid stream and to form the loop-type flow passage of the working liquid due to the action of the check valves 2-1, 2-2. In this way, the outer pipe container t in which the loop-type heat pipe aggregates according to the present invention are incorporated can be used as a high performance elongated cylindrical heat pipe device which has solved every problem that the conventional heat pipe has (refer to the Background of the art).

In FIG. 16(B), numeral 43 denotes the predetermined filling material made of a material having a good adaptability to the working liquid. It is noted that the clearance blocking means constituted by the predetermined filling material may be put into practice by constricting the outer pipe container so that the aggregate of the pipe containers is deformed in a honeycomb configuration.

The heat pipe in the fourteenth preferred embodiment can use the working liquid of pure water to construct a sufficiently endurable heat pipe having the outer diameter of 25 mm such as operation temperature of 300° C. (the pure water has a saturated vapor pressure of 90 kg/cm$^2$) and thermal transport of 30 kw with the outer pipe container having the outer pipe diameter of 25 mm.

In this way, an advent of the heat pipe which is strong and is usable between 200° C. and 300° C. is demanded.

For example, as disclosed in a specification of Japanese Patent No. 1209357 (corresponding to a Japanese Patent Application Second (Examined) Publication (Tokko) sho 58-38099 published on Aug. 20, 1983), a plastic injection mold or extruder enables a remarkably reduced energy consumption and high-quality, highly efficient mold by means of a heat pipe type screw. However, since the conventional heat pipe requires a large amount of heat transportation, the maximum operation temperature is about 200° C. if the working liquid of pure water is used and the heat transportation is about 3 kw, the applicable plastics are limited, the thermal transportation is insufficient, and consequently the conventional heat pipe cannot be reduced in practice. The heat pipe in the preferred embodiment solves the problem and enables the reduction into the practice of the heat pipe type screw.

The heat pipe in the fourteenth preferred embodiment causes the application temperature range of pure water and Freon-series working liquid to be raised above 100° C. A large capacity of the thermal transportation is made possible. In addition, the use of the heat pipe under the complete top heat (maximum heat) posture is achieved to extend the application range of the heat pipe.

(Fifteenth preferred embodiment)

Figure 17A:
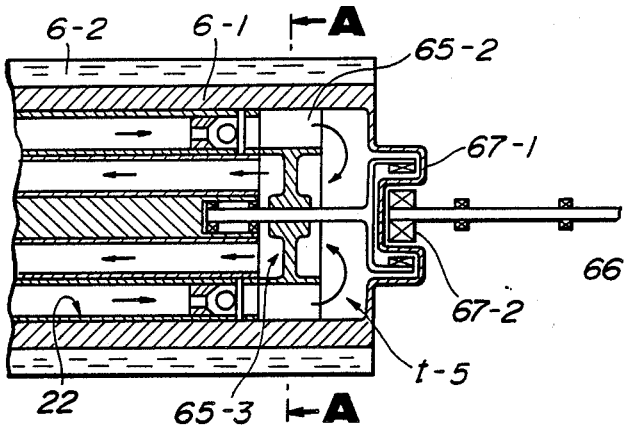
FIGS. 17 (A) and 17(B) are cross sectional views of the pipe containers in the loop-type heat pipe in a fifteenth preferred embodiment according to the present invention which are also applicable to fire-proof and heat-resistant light transmission cables.
Figure 17B:
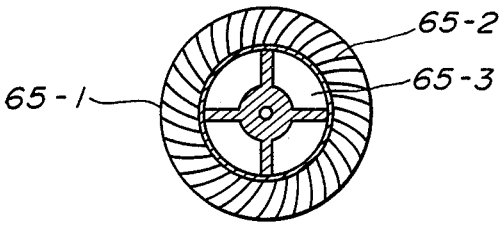

FIGS. 17(A) and 17(B) show a fifteenth preferred embodiment of the heat pipe according to the present invention.

In the fifteenth preferred embodiment, the outer pipe container t in the fourteenth preferred embodiment has a high pressure resisting structure, one or both of the cavity chambers corresponding to the headers are enlarged, and a turbine which rotates in response to the working liquid stream or vapor stream and means for outputting a rotational energy of the turbine are installed. The loop-type heat pipe in the fifteenth preferred embodiment circulates the working liquid or its vapor within the pipe container at a high speed.

In FIGS. 17(A) and 17(B), numeral 65 denotes the turbine, numeral 65-1 denotes the turbine wheel, numeral 65-2 denotes the turbine blade, numeral 65-3 denotes a circulating hole for passing the working liquid into a part of the pipe container which corresponds to the forward stream passage of the working liquid, symbol t-5 denotes the header portion, and numeral 67 denotes energy outputting means. In FIGS. 17(A) and 17(B), the energy outputting means includes an outer wheel magnet 67-1 and inner wheel magnet 67-2 which rotate integrally with the turbine 65. The outer wheel magnet 67-1 rotates within the outer pipe container 6-1 and drives the inner wheel magnet 67-2 outside of the outer pipe container 6-1 spaced via the outer pipe container wall to rotate and its rotating force is transmitted to an output axle 66. The energy outputting 67 utilizes the magnet or alternative means.

(Sixteenth and seventeenth preferred embodiments)

FIGS. 18(A) to 18(D) show sixteenth and seventeenth preferred embodiments of the heat conductive pipe according to the present invention.

In these preferred embodiments, the elongate container according to the present invention shown in FIG. 11(A) is simultaneously used as a winding used in electric motors, generators, transformers and electromagnetic magnets.

The above-described winding is classified into, so called, a winding of a kind used primarily for a large capacity winding in which a cotton yarn, a cotton tape, a paper tape, and, so on, is tightly wound around a conductor and, so called, an enameled wire primarily used for a medium or small capacity winding formed with a baking coating of an insulating enamel painting treated around a periphery of the conductor.

In the sixteenth preferred embodiment, the elongate thin pipe constituting the loop-type container is formed as a hollow electric copper wire or a hollow electric aluminium wire and an electric insulating fiber such as the cotton yarn, cotton tape, or paper tape is tightly coated around the outer periphery of a naked wire.

In the seventeenth preferred embodiment, in place of the spirally wound coating cf the electrically insulating fibers in the sixteenth preferred embodiment the elongate thin pipe constituting the loop-type container is formed as the hollow electric enameled wire with the outer periphery of the naked wire baking coated with various kinds of enamel paints in which a tung oil, polyurethane, polyester, polyamide, and polyimide are main constituents.

In the seventeenth preferred embodiment, the heat receiving portion is abutted to a temperature controlled object in which the transfer of the amount of heat is not carried out. Hence, a reduction of the heat radiating capability dependent upon the wall thickness of the electric insulating object (in general, heat insulating object) does not matter.

A self heat generation caused by electric power loss of the heat pipe container in the inside of the wound object is absorbed itself and radiated outside of the wound object.

These preferred embodiments have superior characteristics in easy operability, volume ratio upon completion of the windings, and heat absorption efficiency as compared with the cooling caused by winding the elongate juxtaposed heat pipe containers in the ninth preferred embodiment shown in FIGS. 11(A). The amount of absorbed heat in the sixteenth and seventh preferred embodiments is radiated externally with the ninth and twelfth preferred embodiments applied as shown in FIG. 14(D) and reduced into practice as shown in FIG. 6(B).

Figure 18A:
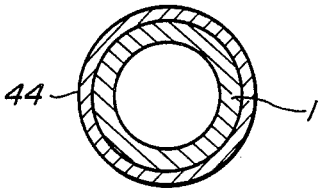
FIGS. 18 (A) to 18 (D) are cross sectional views of the loop-type heat pipes in sixteenth and seventeenth preferred embodiments according to the present invention.
Figure 18B:
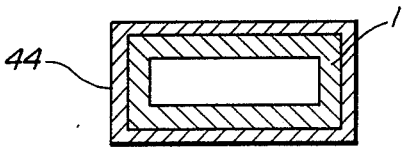

In FIGS. 18(A) and 18(B), the electrical insulation is carried out for each single pipe container.

Figure 18C:
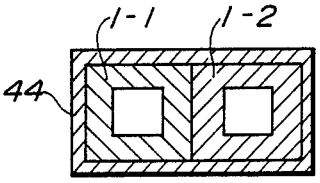
Figure 18D:
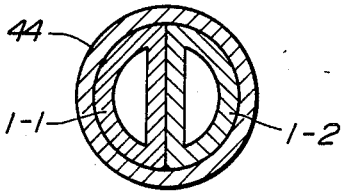

In FIGS. 18(C) and 18(D), the parallel pipes are integrally insulated or the adhered and juxtaposed pipes are insulated. Numerals 1, 11, 22 denote the pipe container and numeral 4 (44) denotes an insulating coating of the spiral winding or baked winding.

For example, the electric motor, generator, transformer, electromagnetic magnet, and so on in which the pipe containers are formed as windings or a part of the windings can remarkably increase an allowable current regardless of the volume increase due to the use of the hollow conductors. Consequently, the wound object can be small-sized and reinforced.

(Eighteenth preferred embodiment)

FIGS. 19 (A) to 19(F) show an eighteenth preferred embodiment of the loop-type heat pipe according to the present invention.

A fire-proof electric wire, fire-proof cable, flame-resistant cable, and heat-resistant cable are electric wires and cables for continuing the power supply to an important installation within a building for a predetermined period of time until an initial fire fighting operation is initiated when the fire occurs.

In the eighteenth preferred embodiment, the thin pipe container of the loop-type heat pipe is used as a conductor of a core of the above-described electric wires and cables in order to cool fire-proof, heat-resistant, and flame-resistant insulating coatings thereof so that a fire-proofing time and heat-resisting time can remarkably be extended or exposure can be prevented.

FIGS. 19 (A) to 19(F) show cross sections of the electric wires and cables in which the single pipe container and juxtaposed pipe containers are applied.

Figures 19A, 19B, 19C:
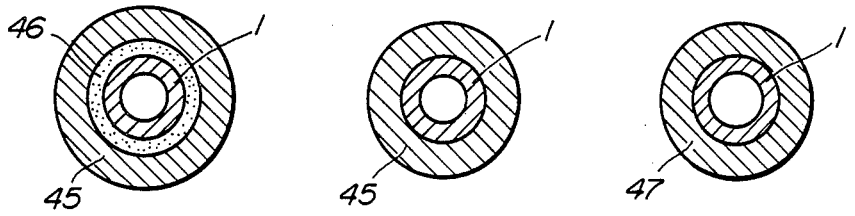
FIGS. 19(A) to 19(F) are diagrammatic cross sectional views of the loop-type heat pipes in an eighteenth preferred embodiment according to the present invention.
Figures 19D, 19E, 19F:
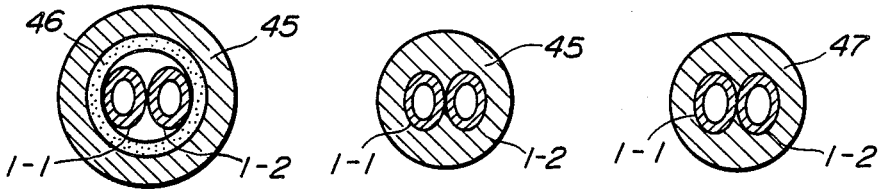

FIGS. 19(A) and 19(D) show the fire-proof structures, FIGS. 19(B) and 19(E) show the heat-resistant structure, and FIGS. 19(C) and 19(F) show the flame-resistant structure.

In FIGS. 19(A) to 19(F), numeral 1 (1-1, 1-2) denotes the pipe container made of an electric conductor, numeral 45 denotes a heat-resistant insulating coating, numeral 46 denotes a fire-proof layer, and numeral 47 denotes a flame-resistant insulating coating.

In the eighteenth preferred embodiment, a fire-proof layer 46 is sufficiently thickened to enlarge a temperature drop percentage within the fire-proof layer and to reduce the thermal transfer rate so that the fire proofing and heat resisting times can be extended and perfect fire-proof and perfect heat resistant electric wires and cables can be constructed.

The fire-proof, heat resistant electric wire of the loop-type heat pipe in the eighteenth preferred embodiment can withstand a high temperature of the fire until the fire is extinguished if its conductor surface temperature is below 300° C. to 350° C. in the case of the pure water working liquid or below 400° C. to 450° C. in the case of the working liquid of naphthalene or thermes.

(Nineteenth preferred embodiment)

FIGS. 20(A) to 20(D) show a nineteenth preferred embodiment of the loop-type heat pipe according to the present invention.

In the nineteenth preferred embodiment, the loop-type heat pipe is applied to the radiation of a power cable.

Figure 20A:
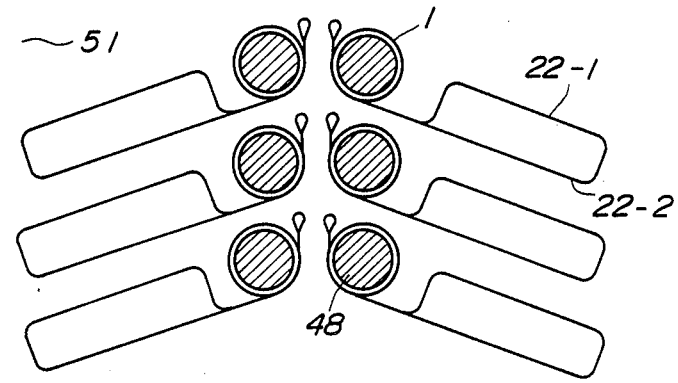
FIGS. 20(A) to 20(D) are diagrammatic cross sectional views of the loop-type heat pipes in a nineteenth preferred embodiment according to the present invention.
Figure 20B:
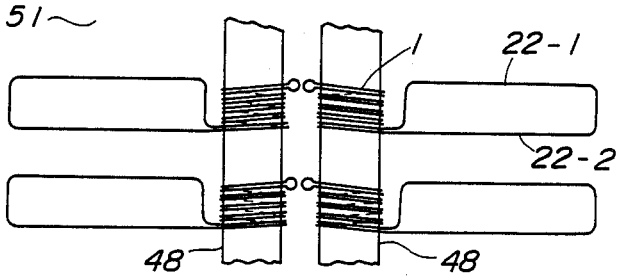
Figure 20C:
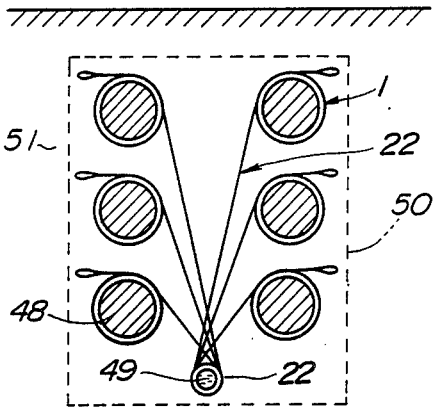
Figure 20D:
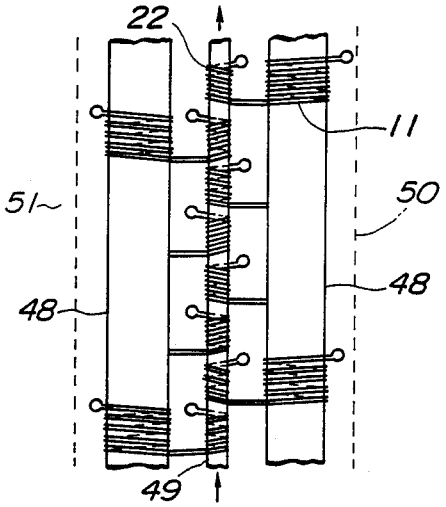

FIGS. 20(A) and 20(B) show an example of application of the heat pipe to a power cable conduit 48 extended directly within the soil 51. FIGS. 20(C) and 20(D) show examples of heat pipe applications to conduits 48 installed within a telephone-tunnel 50 or to a pedrography.

FIGS. 20(A) and 20(C) are cross sectional views of the telephone-tunnel 50 in directions perpendicular to the conduit and FIGS. 20(B) and 20(D) are elevational views of the conduit 48.

Numeral 1 denotes each of the plurality of pipe containers having working liquid stream direction switching portions t-1 to t-6 as shown in FIGS. 5(A) to 5(E) and 5(G). The multiple number of pipe containers may directly be applied or the elongate pipe containers shown in FIG. 11(C), shaped in the zig-zag fashion as shown in FIG. 11(E), may be applied.

The heat receiving portions of the pipe container 1 may be wound around the outer periphery of the cable conduit 48 or extended along the conduit 48 (refer to FIGS. 6(A) and 6(B)).

The heat radiating portions 22, 22-1, 22-2 in FIGS. 20(A) and 20(B) are directly dispersed and expanded in the soil 51.

The heat radiation performance may be improved by extending externally the plurality of pipes in the way denoted by 22-1 and 22-2.

The loop-type pipe containers thus constructed can effectively radiate the heat generated in the conduit 48 toward the soil 51 and can increase the allowable current in the conduit. In FIGS. 20(C) and 20(D), the pipe containers 1 are applied in a case where the forced cooling causes the further increase of the allowable current. The heat radiating portion 22 is wound on a cooling water conduit 49 juxtaposed to the cable conduit 48.

(Twentieth preferred embodiment)

Figures 21A, 21B, 21C:
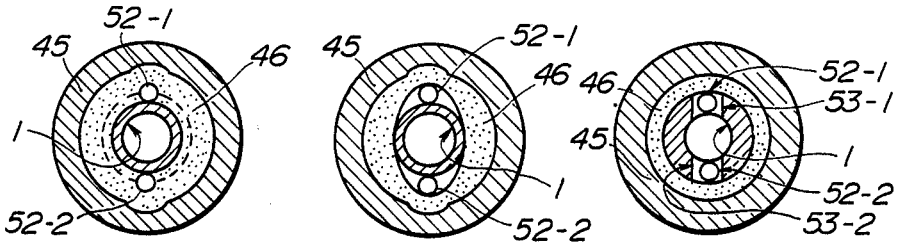
FIGS. 21(A) to 21(C) are diagrammatic cross sectional views of the loop-type heat pipe in a twentieth preferred embodiment according to the present invention.

FIGS. 21(A) to 21(C) show a twentieth preferred embodiment of the loop-type heat pipe according to the present invention.

In FIG. 21(A), optical fibers 52-1, 52-2 are wound around the periphery of the pipe container 1 of the loop-type heat pipe and a fire-proof layer (heat insulating layer) 46 and heat resisting layer (heat relieving layer) 45 are installed at the outside thereof.

In FIG. 21(B), the optical fibers 52-1, 52-2 are extended along two peripheral ends of the container 1 and fire-proof layer 46 and heat resistant layer 45 are installed.

In FIG. 21(C), the optical fibers 52-1, 52-2 are extended in grooves 53-1, 53-2 installed along an outer peripheral wall surface of the container 1 and the fire-proof layer 46 and heat resistant layer 45 are extended around the periphery of the grooves 53-1, 53-2. The heat radiating portion of the pipe container 1 is cooled by means of the water cooling equipment cooperating with the sprinkler or fire signal so as to absorb heat around the optical fibers. Thus, for the predetermined period of time, the functions of the optical fibers can be protected from the surrounding flames of fire and high temperature.

(Twenty first preferred embodiment)

Figures 22A, 22B:
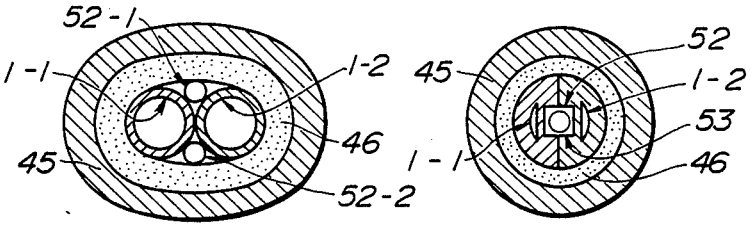
FIGS. 22(A) to 22(C) are diagrammatic cross sectional views of the loop-type heat pipe in a twenty first preferred embodiment according to the present invention.
Figure 22C:
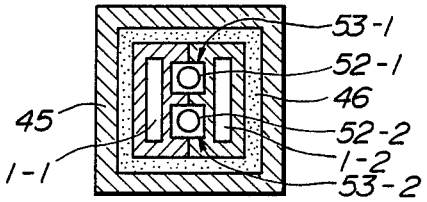

FIGS. 22(A) to 22(C) show a twenty first preferred embodiment of the loop-type container according to the present invention.

In the twenty first preferred embodiment, the pipe containers 1-1, 1-2 are extended parallel to each other and mutually adhered to the fire-proof layer 46.

In FIGS. 22(A), the pipe containers 1-1, 1-2 are circular in section and grooves are formed at both surfaces. The optical fibers 52-1, 52-2 are stored in the grooves and extended along the containers 1-1, 1-2. The cooling effect in the twenty first preferred embodiment is doubled as compared with that in the twentieth preferred embodiment.

If the optical fibers 52-1, 52-2 are coated with metals, the cooling effect is furthermore improved. Thus, the optical information transmission characteristic is perfectly protected from the fire accident.

As shown in FIGS. 22(B) and 22(C), the pipe containers are semi-circular in section and rectangular in section, respectively. Adhesive surfaces of the containers 1-1, 1-2 are flat. The optical fibers 52-1, 52-2 are housed in a cavity formed by grooves 53-1, 53-2 extended along outer walls of the adhesive surfaces of the containers so as to completely interrupt invasions of the fire flames and high temperature.

The fire-proof layer 46 and heat resistant layer 45 relieve the high temperature caused by the fire to prevent too much increase of the saturated vapor pressure of the working liquid in the containers 1-1, 1-2. These layers serve to relieve heat without a complete combustion due to the cooling action of the heat pipe.

(Twenty second preferred embodiment)

Figure 23:
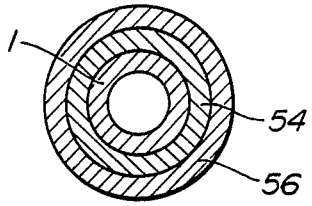
FIGS. 23(A) and 23(B) are diagrammatic cross sectional views of the loop-type heat pipe in a twenty second preferred embodiment according to the present invention.
Figure 23:
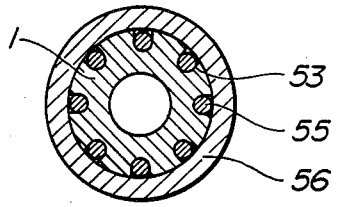

FIGS. 23(A) and 23(B) show a twenty second preferred embodiment of the loop-type heat pipe according to the present invention.

A super conductive object coating layer 54 is installed around the outer periphery of the pipe container 1 and a metallic tube coating 56 made of an electric and heat conductive metallic material is installed. The super conductive object coating layer 54 may be of a tape made of a super conductive material tightly, and spirally wound. In addition, if the super conductive material is of a ceramic series, the super conductive material may directly be sintered around the pipe container 1. In addition, in the case of the cable state, the coating layer may be unsintered and may be sintered after finish (in the case of coil, after the winding).

The material quality of the pipe container 1 and the metallic tube 56 may generally be of pure copper. The pipe container 1, super conductive object coating layer 54, and metallic tube coating 56 may be integrated in a bonding or junction state through a drawing or swaging. The pipe container 1 and metallic tube coating 56 absorb the heat generation due to a destruction of the super conductive state in a minute portion generated during operation to stabilize the super conductive state. In addition, the metallic tube coating 56 serves as electrical insulating coating at the time of super conduction.

In FIG. 23(B), a groove 53 is extended along a wall surface of the outer periphery of the pipe container 1. A super conductive pipe 55 is inserted in the groove 53. The pipe container 1, the super conductive thin wire 55, and metallic tube coating 56 are integrated in the junction state. The action of each part is the same as shown in FIG. 23(A). The pipe container thus constructed can easily be formed as the super conductive wire in the coil shape or other necessary shape. The heat radiating portion cools the wire portion spaced therefrom below its critical temperature and can maintain it in the super conductive state.

The super conductive wire, the application of the loop-type heat pipe, has the following advantages as compared with a conventional immersion type super conductive wire.

(a) Since it is not necessary to immerse the coil portion in the cooling liquid in a case where the super conductive wire is formed, the shape and dimension of the coil are free. The freedom of designing the coil becomes increased.

(b) Since the heat radiating portion (a part immersed in the cooling liquid) is installed at a portion spaced apart from the super conductive wire portion and can be miniaturized, an immersing vessel may be miniaturized even while the coil portion becomes large. Consequently, the heat loss is small and the consumption of the cooling liquid can be saved.

(c) The super conduction of a generator or rotator such as motor can be achieved. That is to say, a coil of a stator can easily be reduced into practice as shown in FIG. 6(B). In the case of a rotor, the coil thereof is formed as shown in FIG. 6(B). In this case, the heat radiating portion 22 drawn from the coil is coaxially arranged around a rotary axle and immersed in the cooling vessel during rotation. Alternatively, the heat radiating portion 22 is introduced into a cooling jacket installed around the rotary axle. The heat generating portion except the coil portion uses the loop-type heat pipe in the ninth preferred embodiment in which the working liquid in the twenty second preferred embodiment is filled. Therefore, the heat radiating portion thereof cools the coil portion to the critical temperature to aid maintaining the super conductive state of the coil portion. It is desirable to cool it to or about the critical temperature in the same way if one of the stator and rotor needs no coil.

(d) When the heat pipe is applied to the super conduction of coils in a large capacity transformer, a cooling vessel of the coil portion can be omitted and the construction of the transformer can remarkably be miniaturized due to no presence of copper loss.

In this case, a heat generation due to an iron loss is sufficiently cooled due to a low temperature of the super conduction wire and the cooling vessel becomes unnecessary. The cooling vessel, in this case, is only a small-sized cooler for cooling the heat radiating portions of the primary coil and secondary coil as shown in the cooling means 6 of FIG. 6(B). However, if the heat generation due to iron loss is remarkable, an auxiliary cooling means is preferably added in the same way as in the item (c).

(e) When the loop-type heat pipe is applied to a power transmission cable, only a simple immersion type cooler as shown in the cooling means of FIG. 6(A) may be installed for each predetermined distance although in the case of a conventional power transmission super conduction cable, an extremely low temperature pump for causing an extremely low cooling liquid to flow in a cooling tube or super conductive cable tube is required for each predetermined distance. That is to say, an installation cost is not only reduced but also a pump maintenance cost is not required.

(Twenty third preferred embodiment)

FIGS. 24(A) to 24(F) show a twenty third preferred embodiment of the loop-type heat conductive pipe according to the present invention.

In the twenty third preferred embodiment, the pipe container 1 (1-1, 1-2) having a rectangular cross section serves to grasp a plurality of super conductive tapes 57 or super conductive fine wires 55.

Figure 24:
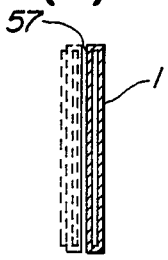
FIGS. 24(A) to 24(F) are diagrammatic cross sectional views of the loop-type heat pipe in a twenty third preferred embodiment according to the present invention.
Figure 24:
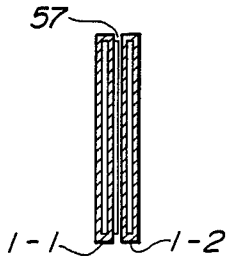
Figure 24:
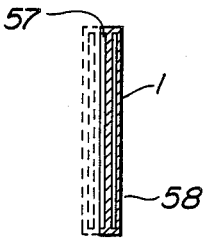
Figure 24:
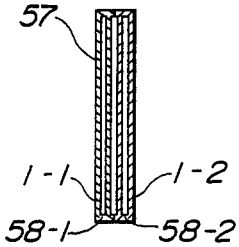
Figure 24:
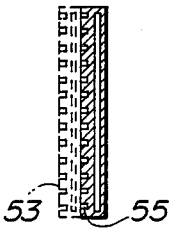
Figure 24:
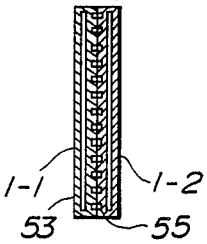

In FIGS. 24(A) and 24(B), the super conductive tapes 57 are grasped on flat surfaces of the container 1. In FIGS. 24(C) to 24(F), the super conductive tapes 57 or super conductive wires 55 are inserted and grasped by means of wire grooves 58 or narrow grooves 53.

FIGS. 24(A), 24(C), and 24(E) show examples of the container on which the tapes or wires are spirally wound. In these cases, the tapes or wires are grasped between the containers at an inner layer side or outer layer side denoted by a broken line. The super conductive tapes are adhered to only one side of the pipe container 1.

In FIGS. 24(B), 24(D), and 24(F), the super conductive object (tapes or wires) is grasped by means of two pipe containers 1-1, 1-2. The action in the 23rd preferred embodiment is the same as that in the 22nd preferred embodiment. The 23rd preferred embodiment is very convenient to form the super conductive coil. Since no meaningless clearance is formed, the cooling efficiency can be improved.

(Twenty fourth preferred embodiment)

Figure 25:
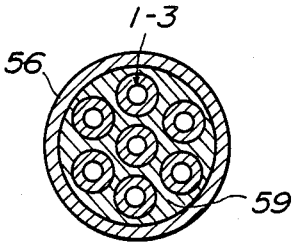
FIG. 25 is a diagrammatic cross sectional view of the loop-type heat pipe in a twenty fourth preferred embodiment according to the present invention.

FIG. 25 shows a twenty fourth preferred embodiment of the loop-type heat container according to the present invention.

As shown in FIG. 25, the loop-type heat pipe is formed as a high capacity power transmitting super conductive cable or as a super conductive cable to constitute a large-sized super conductive coil. The loop-type container in the 24th preferred embodiment is constructed with a super conductive material used as the filling material, e.g., shown in FIGS. 12(A) and 12(B). In the 24th preferred embodiment, each pipe container is previously treated with a coating of the super conductive material before each container is twisted.

In FIG. 25, numeral 1-3 denotes the pipe container group aggregated in the bundle or mutually twisted. The pipe container group 1-3 is inserted in the metallic tube 56 having a high heat and electric conductivity and a high flexibility.

The super conductive material 59 is coated on an outer periphery of each pipe container before aggregation or twisting. When the metallic tube 56 is inserted, all clearances in the tube 56 and pipe container group 1-3 are tightly filled with the super conductive material 59. Preferably, the metallic tube inner wall in the metallic tube, super conductive material, and pipe container outer wall are integrated substantially in the junction configuration by means of predetermined means. The predetermined means is generally a cross-section reduction process caused by drawing or swaging. In the super conductive cable state, the super conductive material 59 is unsintered. After the bonding process during the cable installation and after the bending process to form the super conductive material may be sintered to complete the super conductive material 59.

Since the above-described super conductive cable includes the super conductive material having a large cross sectional area, it is suitable for the high power transmitting conductive wire and large-sized high capacity super conductive transformer. The super conductive cable in which the pipe container group 1-3 is twisted is used in an application in which the flexibility is required. The super conductive cable in which the pipe container group is aggregated in the bundle is used in an application in which a linearity is required. The action in the 24th preferred embodiment is the same as that in the 22nd preferred embodiment.

The loop-type heat pipe according to the present invention as described hereinabove does not only solve the problems described in the Background of the Art but also exhibits such a novel, excellent performance as described below.

(a) No occurrence of spreading limit.

Since the streams of the working liquid and vapor are directed in the same sense, there is no occurrence of the spreading limit.

Therefore, the quantity of the working liquid, the quantity of the heat input, and the speed of the vapor stream can generally be increased. Consequently, the capability for the heat pipe to carry out the thermal transportation can remarkably be increased.

(b) No occurrence of the wick limit.

Since no wick is present in the container 1 but the filled and sealed working liquid is propelled under vapor pressure, the increase of the thermal input does not make it difficult to circulate the working liquid but increases the circulating speed.

(c) No occurrence of the abnormalities due to a sudden boiling as in the water hammer action.

Since the filled working liquid is driven under a vapor pressure, the circulation speed of the working liquid is increased even if the sudden and large amount of heat input is carried out and the whole amount of heat can completely be absorbed.

Due to the characteristics described in the items (a), (b) and (c), the loop-type heat conductive pipe according to the present invention has a capability of transferring the large amount of heat irrespective of the small-diameter heat pipe.

(d) There is no limit in the tape length and the manufacture of the heat pipe is possible.

Theoretically, there is no limit due to a strong driving force of the working liquid and an amplification action of the driving force in the plurality of heat receiving and heat radiating portions. Practically, the manufacture of the loop-type heat pipe having a length from 500 meters to 2000 meters can be achieved.

The extremely thin heat pipe can be manufactured due to the same flow direction in the working liquid stream and vapor stream and no presence of mutual interference. An experiment indicated the operation of the loop-type heat pipe having the inner diameter of 0.5 mm.

(e) No matter how posture the application of the heat pipe takes, the heat pipe can exhibit a sufficiently good performance.

The performance of the heat pipe is not affected by weight due to the strong working liquid propelling force and of a high-speed working liquid. Hence, it is not necessary to take the change of performance due to the change in performance caused by a posture of the heat pipe in mounting.

(f) Extremely large freedom of mounting of the heat pipe.

The performance does not change depending upon change in mounting posture and the loop-type container can easily be bent through a predetermined means. The heat pipe can be used with the body thereof flexible at an arbitrary direction.

Particularly, in the case of the completely annealed copper pipe having an outer diameter below 4 mm or the container formed of the aluminium pipe, such heat pipes can freely be flexed through the manual operation. It is also possible to carry out a surface heat reception and surface heat radiation with a flat surface formed through several turns of the container.

Since such a loop-type heat pipe in which a suitably formed stream direction switching portion is installed on both ends of the elongate loop-type container and the intermediate portions of the container are juxtaposed can be used as parallel wire or tape materials, the degree of freedom upon mounting can be increased. That is to say, winding, mating, and adhering of the container can freely be carried out and the plurality of heat receiving portions and heat radiating portions can freely be formed in the container.

Figure 5:
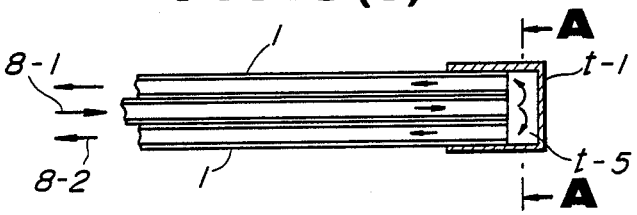
Figure 5:
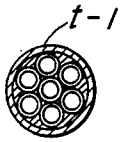
Figure 5:
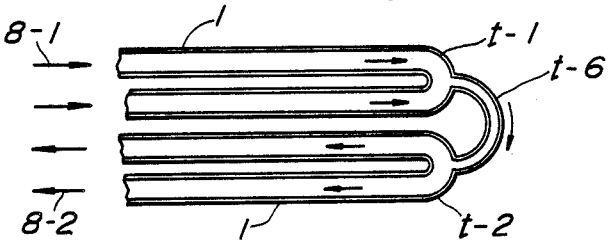

FIGS. 5 (A) to 5 (K) show various types of structures of stream direction switching portions t-1 of the working liquid to form such juxtaposed wire materials and tape materials.

FIG. 5 (A) shows the stream direction switching portion t-1 in a letter U-shaped bent pipe to form the juxtaposed pipe.

FIG. 5 (B) shows the stream direction switching portion t-1 in a circular shape to form a mutually contacted juxtaposed pipe.

FIGS. 5 (C) and 5(D) show the structure of the heat pipe container having a common penetrating hole t-3 to form an adhered, juxtaposed pipe 1.

FIGS. 5 (E) and 5(F) show the structure of the heat pipe container having a small-sized header t-5 to form the adhered, juxtaposed pipe 1.

FIGS. 5(I) and 5(J) show the structure of the heat pipe container having the small-sized header t-5 to form a multiple number of parallel bundled pipes.

FIG. 5(K) shows the structure having the plurality of bent pipe portions t-1, t-2, and t-6 to form the multiple number of parallel pipes.

Figure 6:
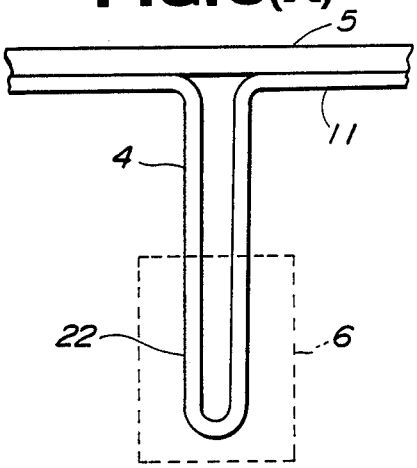
FIGS. 6 (A) to 6 (C) are diagrammatic views of examples of juxtaposed loop-type containers of the loop-type heat pipe structure according to the present invention.
Figure 6:
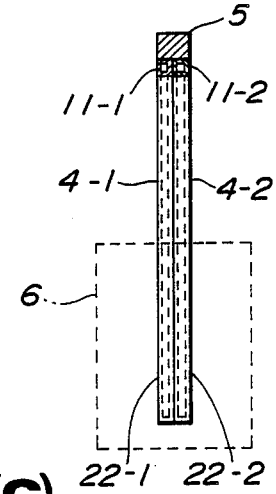
Figure 6:
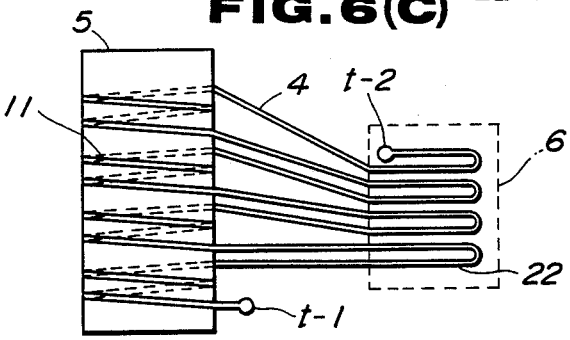

FIGS. 6 (A) to 6 (C) diagrammatically show the configurations of the representative juxtaposed heat pipe containers in FIGS. 5(A) to 5(K).

FIG. 6 (A) shows a state in which the juxtaposed pipe is tightly adhered to an elongated heat generating object 5.

FIG. 6 (B) shows the juxtaposed pipe shown in FIG. 6 (A).

In FIGS. 6 (A) and 6 (B), the heat receiving portion 11 (11-1, 11-2) is adhered to the elongated heat generating object 5, the heat radiating portion 22 is placed within cooling means 6.

The heat radiating portion shown in FIG. 6 (A) is one of the plurality of the heat radiating portions.

FIG. 6 (B) shows an example of the heat receiving portion 11 which is brought in close contact with a cylindrical heat generating object 5 and is wound therearound in a spirally wound coil shape. The heat radiating portions 22 are placed within the cooling means 6 via the heat insulating portion 4 whenever the heat radiating portions 22 are turned within the cooling means 6. In this example of application, the length of the loop-type container of the juxtaposed pipe exceeds 1000 meters. Numerals 4-1 and 4-2 denote the heat insulating portions.

The heat transportation, in this case, may exceed 100 KW. The loop-type heat pipe according to the present invention can be constructed by a single juxtaposed pipe container having the inner diameter of 2 to 3 mm in which the heat insulating portions 4-1, 4-2 are juxtaposed.

(g) Extreme easiness in operation for sealing the working liquid within the container.

Since the working liquid and its vapor are always circulated at high speeds, the performance of the heat pipe is not deteriorated and the operation of the heat pipe is not stopped, even if a small amount of the non-condensative gas enters and mixed with the working liquid in the container due to a stay of the non-condensative gas within a part of the container. Hence, it is not necessary to pay the closest attention to the magnitude of the high vacuum pressure within the container at the time of filling of the operating liquid.

Hence, it becomes possible to fill the working liquid through a convenient method such as, so called, a vapor method and condensation method.

In addition, the filling of the working liquid at a disposition site, the regeneration of the working liquid, replacement of the working liquid due to the change in performance become possible.

The loop-type heat pipe according to the present invention has the following characteristics.

(h) No sudden deterioration in the heat pipe characteristics as in the conventional heat pipe structure.

Hence, since the function is not abruptly dropped in an apparatus in which the heat pipe is not assembled, it becomes possible to carry out a regular regeneration. Therefore, it is convenient in terms of maintenance.

(i) A range of temperature of the working liquid which has conventionally been applied can be increased by a temperature ranging from about 100° C. to 150° C.

The pipe container has a high-pressure resistance limit and only a slight increase of a wall thickness thereof can achieve a high-pressure resistive characteristic.

For example, since the commercially available pure copper pipe having an outer diameter of 3.2 mm and inner diameter of 2 mm can withstand the inner pressures of 270 Kg/cm$^2$ at room temperature and of 90 Kg/cm$^2$ at 350° C. The saturated vapor pressure of a pure water working liquid is 90 Kg/cm$^2$ at 350° C., the loop-type heat pipe formed of the above-described commercially available pure copper pipe can be used with safety at 250° C. The safety usable temperature range of the conventional heat pipe was 200° C. in the pure water working liquid and was 100° C. in the working liquid made of Freon-11 (trichlorofluoromethane). This is an important characteristic and such as a working liquid exhibiting the sufficient performance at the temperature 200° C. to 350° C. is readily commercially available.

(j) If the heat input exceeds the predetermined magnitude, the temperature becomes constant (in the case where the working liquid is a pure water) with respect to the increase in the thermal input or the temperature becomes substantially constant (in the case where the working liquid is Freon-11). Therefore, a maximum quantity of heat transportation can extremely be increased.

This function may be caused by synergistic effects of a reduction percentage of a dynamic viscosity coefficient in the working liquid reduced together with the temperature rise and of an increase percentage of the saturated vapor pressure in the working liquid increasing together with the temperature rise of the saturated vapor pressure in the working liquid. The above-described specific function is a unique to the loop-type heat pipe according to the present invention. This function permits a remarkable increase of the maximum heat transportation and provides a safe heat transportation means for the heating and cooling of the temperature controlled object such that the temperature rise above the predetermined temperature and abrupt change in temperature bring the heat pipe structure in a dangerous state.

(k) Even if any working liquid whose heat transportation capability is too low to be used in the conventional heat pipe since the latent heat in vaporization and condensation are too small, the cooling capability of the heat pipe can remarkably be increased for any working liquid having a low dynamic viscous coefficient and high saturated vapor pressure.

The above-described characteristic is unique in that the loop-type heat pipe according to the present invention has and may be considered to be caused by the remarkable increase in the circulating speed of the working liquid. It is necessary to reevaluate all of the conventional heat transportation capabilities in various working liquids for the heat pipe according to the present invention. If Freon-11 is used in the conventional heat pipe, the heat transportation capability was only a fraction of the pure water used for the working liquid (provided that the temperature at the heat receiving portion ranges from 40° C. to 100° C.). If Freon-11 is used in the loop-type heat pipe according to the present invention, the loop-type heat pipe can exhibit the heat transportation capability which is 10% to 50% larger than the pure water working liquid used in the conventional heat pipe.

the inventor made a specimen of a zig-zag shaped loop-type heat pipe having a whole length of 20 meters, 20 heat receiving portions, 20 heat radiating portions, the length of 100 mm of each heat receiving portion and each heat radiating portion. In addition, the inventor compared a thermal resistance value with respect to the thermal input in a case where the pure water was used as the working liquid and in a case where Freon-11 was used thereas. The measurement condition was such that a bent pipe portion of the loop was soaked in a low-speed water stream to form the heat radiating portion, parts in the vicinity of other ends were juxtaposed and grasped by means of two heater block planes, and measured in a vertical top heat posture. (i) The pure water was used for the working liquid.

(i) The pure water was used for the working liquid.

| Heat Receiving Portion Heat Input (W) | Heat Radiating Portion Warmed Water (°C.) | Heat Receiving Portion & Heat Pipe °C. Ind. Temp. | Temperature Rise t(°C.) | Thermal Resist. Value (°C./W) |
|---|---|---|---|---|
| 312 | 17.8 | 90.5 | 72.7 | 0.233 |
| 516 | 18.6 | 94.8 | 76.2 | 0.148 |
| 700 | 18.6 | 95.3 | 76.7 | 0.110 |
| 928 | 18.6 | 94.5 | 75.9 | 0.082 |

(ii) Freon-11 was used for the working liquid.

| Heat Receiving Portion Heat Input (W) | Heat Radiating Portion Warm Water Temp. (°C.) | Heat Receiving Portion Heat Pipe Indicating Temp. (°C.) | Temp. Rise delta t °C. | Thermal Resistance Value (°C./w) |
|---|---|---|---|---|
| 314 | 23.4 | 82.6 | 59.2 | 0.189 |
| 509 | 24.1 | 93.6 | 69.5 | 0.137 |
| 702 | 24.1 | 94.1 | 69.7 | 0.099 |
| 918 | 24.1 | 95.2 | 70.8 | 0.077 |

Since an easy measurement method is used, a contact thermal resistance is increased so that a contact between a surface of the heat pipe heat receiving portion and block plane provides no surface contact. The increasing thermal resistance may empirically range from about 0.05° C./W to 0.07° C./W. Therefore, a value subtracted from the measurement data by at least 0.05° C. may indicate a true thermal resistance value.

However, the following trend can be recognized.

(i) In the case of the pure water working liquid, the temperature is constant when the thermal input exceeds 500 w. In case of Freon-11, the temperature rise is extremely small.

(ii) Freon-11 whose latent heat is only 1/13 of the pure water indicates a more preferable thermal resistance value than the pure water. This is because the saturated water vapor pressure at 95° C. of Freon-11 is ten times as large as the pure water and the dynamic viscous coefficient is about $\frac{1}{3}$. For that reason, the circulating speed of the working liquid becomes extremely fast so that the latent heat is reduced and further overcome.

(iii) Since a soft copper pipe having an inner diameter of 2 mm and outer diameter of 3 mm has a pressure resistant force above 240 kg/cm$^2$ at normal temperature and above 160 Kg/cm$^2$ at 200° C. with the saturated vapor pressures of the pure water and Freon-11 taken into account, the soft copper pipe can be used at a higher temperature above 150° C. in the case of the pure water working liquid and up to a temperature of the heat receiving portion higher than the experiment value substantially by 100° C. in the case of the Freon-11 working liquid. Hence, the maximum amount of heat transport of the zig-zag shaped heat pipe used in the experiment is estimated to reach about 10 KW. On the other hand, the maximum amount of heat transport of the heat pipe having the inner diameter of 2 mm and outer diameter of 3 mm was only below 500 W even when the 20 pieces of the heat pipes are juxtaposed.

The loop-type heat pipe according to the present invention provides novel features described above and great number of its application fields. The application fields are not limited to those described in the preferred embodiments but many application fields to which the heat pipes are needed are possible.

It will be appreciated by those skilled in the art that the foregoing description may be made in terms of the preferred embodiments and various changes and modifications may be made without departing from the scope of the present invention which is to be defined by the appended claims.

What is claimed is:

1. A structure of a loop-type heat pipe, comprising:

(a) a continuous elongate tube of continuous capillary dimension having both ends thereof air-tightly connected to each other to form a continuous capillary loop-type flow passage;

(b) a heat carrying fluid within the elongate tube in an amount sufficient to allow flow of the fluid through the loop flow passage in a closed state defined by the elongate tube;

(c) at least one heat receiving portion located on a first part of the elongate tube for heating the fluid therein;

(d) at least one heat radiating portion located on a second part of the elongate tube for cooling the fluid therein; and (e) flow control means located within the loop-type flow passage for limiting flow of the heat carrying fluid to a single direction in the flow passage, the flow control means together with mutual actions of vapor pressure generated due to the vaporization at the heat receiving portion and attracting force generated due to condensation of vapor at the heat radiating portion providing propelling force and amplifying the propelling force for the heat carrying fluid so as to circulate the heat carrying fluid in the single direction in the flow passage from the heat receiving portion to the heat radiating portion.

2. A structure of the loop-type heat pipe as set forth in claim 1, wherein the heat carrying fluid includes a bi-phase changeable condensative fluid and the amount of the heat carrying fluid filled in the flow passage is below substantially 95 percent with respect to a volume of the flow passage.

3. A structure of the loop-type heat pipe as set forth in claim 1, wherein the elongate pipe has an inner diameter capable of circulating the heat carrying fluid through the flow passage irrespective of the amount of the heat carrying fluid.

4. A structure of the loop-type heat pipe as set forth in claim 1, wherein at least either of the heat receiving or radiating portions has a sufficiently extended heat transmission area.

5. A structure of the loop-type heat pipe as set forth in claim 1, wherein the heat carrying fluid comprises a predetermined amount of a predetermined working liquid mixed with a predetermined amount of non-condensative gas.

6. A structure of the loop-type heat pipe as set forth in claim 1, wherein the elongate pipe is made of a soft metal and wherein the heat carrying fluid is a working liquid such that a total product value of numerical values of a saturated vapor pressure thereof indicated in a predetermined temperature region and of an inverse number of a liquid-phase dynamic viscosity coefficient at each same temperature is greater than that of Freon-11 at each same temperature.

7. An structure of the loop-type heat pipe as set forth in claim 6, wherein the elongate pipe is made of pure copper.

8. A structure of the heat pipe as set forth in claim 6, wherein the elongate pipe is made of aluminum.

9. A structure of the loop-type heat pipe as set forth in claim 1, wherein all or predetermined part of the elongate pipe is completely annealed or softened so that the elongate pipe is universally flexed.

10. A structure of the loop-type heat pipe as set forth in claim 1, wherein the heat receiving portion and heat radiating portion are provided in an elongate pipe in a couple for each part of the elongate pipe and wherein the first means comprises two check valves located so as to sandwich the couple of the heat receiving and radiating portions.

11. A structure of the loop-type heat pipe as set forth in claim 10, wherein a predetermined portion between a heat receiving portion and heat radiating portion is formed of another pipe made of an electrically insulating material capable of resisting the internal and external pressures and resisting a predetermined number of temperature cycles and the working liquid comprises an electrically insulative working liquid.

12. A structure of the loop-type heat pipe as set forth in claim 10, wherein a plurality of elongated pipes corresponding to forward and rearward stream passages of the working liquid are provided to form the loop-type container, the plurality of elongate pipes being mutually twisted at a predetermined part thereof.

13. A structure of the loop-type heat pipe as set forth in claim 12, wherein the predetermined part is a heat receiving portion and is held within a metallic tube, all clearance within the metallic tube being filled with a filling material.

14. A structure of the loop-type heat pipe as set forth in claim 12, wherein the predetermined part is the heat radiating portion.

15. A structure of the loop-type heat pipe as set forth in claim 10, wherein the elongate pipe has a plurality of bent portions having a predetermined radius of curvatures to form a zig-zag shaped loop-type container, the bent portions forming stream direction switching portions of the working liquid.

16. A structure of the loop-type heat pipe as set forth in claim 15, wherein each turned portion of the elongate pipe is formed of a heat insulating portion, the heat insulating portions being bundled, inserted, and held into a predetermined tubular structure, all clearances within the tubular structure being air-tightly filled with a predetermined filling material.

17. A structure of the loop-type heat pipe as set forth in claim 15, wherein the elongate pipe constitute a heat exchanger.

18. A structure of the loop-type heat pipe as set forth in claim 1, wherein the first means comprises at least one check valve disposed in the flow passage of the elongate pipe except the heat receiving and radiating portions.

19. A structure of the loop-type heat pipe as set forth in claim 18, wherein the check valve includes a valve seat formed of a thin capillary in an internal wall of the flow passage, a valve body formed of a ball made of corundum ($Al_2O_3$), and valve body stopper for maintaining A valve body float at a position within a predetermined distance from the valve seat.

20. A structure of the loop-type heat pipe as set forth in claim 19, wherein the valve body is made of aluminum.

21. A structure of the loop-type heat pipe as set forth in claim 19, wherein the valve body is made of pure copper.

22. A structure of the loop-type heat pipe as set forth in claim 1, wherein the first part of the elongate pipe is disposed in parallel to the second part of the elongate pipe, with a portion thereof linking both first and second parts being bent through a predetermined radius of curvature to form a direction switching portion of the heat carrying fluid.

23. A structure of the loop-type heat pipe as set forth in claim 1, wherein the elongate pipe is constituted by a plurality of mutually juxtaposed thin pipes, one end of the juxtaposed pipes being linked through a linkage member.

24. A structure of the loop-type heat pipe as set forth in claim 23, wherein the linkage member comprises a header which integrally links a plurality of the elongate pipes to form a stream direction switching portion of the working liquid.

25. A structure of the loop-type heat pipe as set forth in claim 23, wherein the linkage member comprises a bent pipe having a predetermined radius of curvature which links one group of the juxtaposed pipes in which the working liquid streams toward the bent pipe with another group of the juxtaposed pipes in which the working liquid streams from the bent pipe.

26. A structure of the loop-type heat pipe as set forth in claim 25, wherein each of the juxtaposed pipes has any one of cross sections in circular, elliptical, square, rectangular shapes, and a multiple number of capillary grooves.

27. A structure of the loop-type heat pipe as set forth in claim 1, wherein an outer surface of an elongate pipe is covered with an electrically insulating coating having a heat resistant characteristic according to a use temperature of the elongate pipe and a good heat conductivity.

28. A structure of the loop-type heat pipe as set forth in claim 27, wherein the electrically insulating coating is an enamel paint baked coating.

29. A structure of the loop-type heat pipe as set forth in claim 1, wherein the elongate pipe constitutes a winding used in an electric motor, generator, transformer, and electromagnet.

30. A structure of the loop-type heat pipe as set forth in claim 1, wherein the elongate pipe constitutes a conductor of an electric wire used to cool an insulating coating for preventing fire of the wire.

31. A structure of the loop-type heat pipe as set forth in claim 30, wherein the elongate pipe comprises a plurality of loop-type containers incorporated into a sealed metallic tube, the sealed metallic tube having a cavity chamber constituting the stream direction switching portion of the working liquid at each one end of the loop-type containers.

32. A structure of the loop-type heat pipe as set forth in claim 31, wherein the cavity chamber is provided with a rotary turbine which rotates in response to the stream of the working fluid and means for outputting a rotation energy of the rotary turbine externally.

33. A structure of the loop-type heat pipe as set forth in claim 1, wherein the elongate pipe constituting the loop-type container is formed as a hollow electric wire.

34. A structure of the loop-type heat pipe as set forth in claim 33, wherein the hollow electric wire is coated with an electrically insulating fiber.

35. A structure of the loop-type heat pipe as set forth in claim 34, wherein the hollow electric wire is coated with an enamel painting in which any one of tung oil, polyurethane, polyester, polyamide, or polyimide is a main constituent.

36. A structure of the loop-type heat pipe as set forth in claim 1, wherein the first means includes a heat radiating portion and heat receiving portion, the heat radiating portion being wound on a conduit of an electric power cable in an underground, the heat radiating portion being extended in a soil.

37. A structure of the loop-type heat pipe as set forth in claim 1, which further comprises a plurality of optical fibers extended around the elongate pipe, a flame resistant layer extended around the optical fibers, and a heat resistant layer extended around the flame resistant layer.

38. A structure of the loop-type heat pipe as set forth in claim 37, wherein the optical fibers are extended around the elongate pipe via grooves.

39. A structure of the loop-type heat pipe as set forth in claim 1, which further comprises a super conductive object coating layer extended around an outer periphery of the elongate pipe and a metallic tubular coating extended around the super conductive object coating layer.

40. A structure of the loop-type heat pipe as set forth in claim 39, wherein the metallic tubular coating is made of pure copper.

41. A structure of the loop-type heat pipe as set forth in claim 39, wherein the super conductive object coating layer, the metallic tubular coating, and elongate pipe are integrated by drawing or swaging process.

42. A structure of the loop-type heat pipe as set forth in claim 1, wherein the elongate pipe has a cross section in a rectangular shape and which further comprises a plurality of super conductive objects in tape forms grasped by means of the elongate pipe container.

43. A structure of the loop-type heat pipe as set forth in claim 1, wherein the elongate pipe has a cross section in a rectangular shape and which further comprises a plurality of wires made of super conductive objects.

44. A structure of the loop-type heat pipe as set forth in claim 1, wherein the elongate pipe comprises a plurality of pipes in a group, the pipe group being placed within a metallic tube and an outer periphery thereof being coated with a super conductive material, all gaps provided between the inner wall of the metallic tube and the pipe group being filled with a super conductive material and wherein the working fluid includes a low temperature workable liquid which operates sufficiently at a temperature lower than a critical temperature of the super conductive material.

* * * * *